US011424057B2

(12) United States Patent
Park et al.

(10) Patent No.: US 11,424,057 B2
(45) Date of Patent: Aug. 23, 2022

(54) POWER INDUCTOR

(71) Applicant: MODA-INNOCHIPS CO., LTD., Ansan-Si (KR)

(72) Inventors: In Kil Park, Seongnam-Si (KR); Gyeong Tae Kim, Ansan-Si (KR); Ki Joung Nam, Siheung-Si (KR)

(73) Assignee: MODA-INNOCHIPS CO., LTD.

( * ) Notice: Subject to any disclaimer, the term of this patent is extended or adjusted under 35 U.S.C. 154(b) by 794 days.

(21) Appl. No.: 16/314,659

(22) PCT Filed: Jul. 17, 2017

(86) PCT No.: PCT/KR2017/007654
§ 371 (c)(1),
(2) Date: Dec. 31, 2018

(87) PCT Pub. No.: WO2018/016821
PCT Pub. Date: Jan. 25, 2018

(65) Prior Publication Data

US 2019/0318854 A1 Oct. 17, 2019

(30) Foreign Application Priority Data

Jul. 19, 2016 (KR) ..... 10-2016-0091658

(51) Int. Cl.

| | |
|---|---|
| ***H01F 27/28*** | (2006.01) |
| ***H01F 1/06*** | (2006.01) |
| ***H01F 1/26*** | (2006.01) |
| ***H01F 27/29*** | (2006.01) |

(52) U.S. Cl.
CPC ..... *H01F 1/06* (2013.01); *H01F 1/26* (2013.01); *H01F 27/29* (2013.01)

(58) Field of Classification Search
USPC ..... 336/229, 188, 212, 219
See application file for complete search history.

(56) References Cited

U.S. PATENT DOCUMENTS

| | | | | |
|---|---|---|---|---|
| 2014/0009254 | A1* | 1/2014 | Ohkubo | H01F 27/29 336/192 |
| 2014/0077914 | A1 | 3/2014 | Ohkubo et al. | |
| 2016/0015550 | A1 | 1/2016 | Evans et al. | |
| 2016/0126004 | A1 | 5/2016 | Yang et al. | |
| 2016/0155550 | A1* | 6/2016 | Ohkubo | H01F 1/24 336/233 |
| 2016/0180995 | A1* | 6/2016 | Park | H01F 17/0013 336/233 |

(Continued)

FOREIGN PATENT DOCUMENTS

| | | |
|---|---|---|
| CN | 104733156 A | 6/2015 |
| CN | 105097187 A | 11/2015 |

(Continued)

OTHER PUBLICATIONS

Written Opinion for PCT/KR2017/007654 dated Oct. 23, 2017.

(Continued)

*Primary Examiner* — Shawki S Ismail
*Assistant Examiner* — Kazi S Hossain
(74) *Attorney, Agent, or Firm* — Renaissance IP Law Group LLP

(57) ABSTRACT

Provided is a power inductor. The power inductor includes a body including metal powder and a polymer, at least one base provided in the body, and at least one coil pattern disposed on at least one surface of the base. The metal powder includes at least three metal powder of which middle values of grain-size distribution are different from each other.

13 Claims, 21 Drawing Sheets

(56) References Cited

U.S. PATENT DOCUMENTS

| | | | | |
|---|---|---|---|---|
| 2016/0351316 | A1* | 12/2016 | Ohkubo | H01F 27/325 |
| 2018/0197679 | A1* | 7/2018 | Lee | B22F 1/0074 |
| 2018/0211762 | A1* | 7/2018 | Jung | H01F 41/046 |
| 2019/0189340 | A1* | 6/2019 | Kim | H01F 3/10 |

FOREIGN PATENT DOCUMENTS

| | | | |
|---|---|---|---|
| CN | 105655102 | A | 6/2016 |
| CN | 105702417 | A | 6/2016 |
| JP | 2004273564 | A | 9/2004 |
| JP | 2007067214 | A | 3/2007 |
| JP | 2007200962 | A | 8/2007 |
| JP | 2016015357 | A | 1/2016 |
| KR | 20070032259 | A | 3/2007 |
| KR | 20130123252 | A | 11/2013 |
| KR | 20150134014 | A | 12/2015 |
| KR | 20160034802 | A | 3/2016 |
| KR | 20160076656 | A | 7/2016 |
| KR | 20160076840 | A | 7/2016 |
| TW | 201236031 | A | 9/2012 |
| TW | 201618135 | A | 5/2016 |

OTHER PUBLICATIONS

International Search Report for PCT/KR2017/007654 dated Oct. 23, 2017.
Extended European Search Report for Application No. 17831294.8 dated Dec. 5, 2019.

* cited by examiner (a)

(b)

(a)

(b)

(a)

(b)

(a)

(b)

(a)

(b)

POWER INDUCTOR

TECHNICAL FIELD

The present disclosure relates to a power inductor, and more particularly, to a power inductor having superior inductance properties and improved insulation properties and thermal stability.

BACKGROUND

A power inductor is mainly provided in a power circuit such as a DC-DC converter within a portable device. The power inductor is increasing in use instead of an existing wire wound choke coil as the power circuit is switched at a high frequency and is miniaturized. Also, the power inductor is being developed in the manner of miniaturization, high current, low resistance, and the like as the portable device is reduced in size and multi-functionalized.

The power inductor according to the related art is manufactured in a shape in which a plurality of ferrites or ceramic sheets made of a dielectric having a low dielectric constant are laminated. Here, a coil pattern is formed on each of the ceramic sheets, and thus, the coil pattern formed on each of the ceramic sheets is connected to the ceramic sheet by a conductive via, and the coil patterns overlap each other in a vertical direction in which the sheets are laminated. Also, in the related art, the body in which the ceramic sheets are laminated may be generally manufactured by using a magnetic material composed of a four element system of nickel (Ni), zinc (Zn), copper (Cu), and iron (Fe).

However, the magnetic material has a relatively low saturation magnetization value when compared to that of the metal material, and thus, the magnetic material may not realize high current properties that are required for the recent portable devices. As a result, since the body constituting the power inductor is manufactured by using metal powder, the power inductor may relatively increase in saturation magnetization value when compared to the body manufactured by using the magnetic material. However, if the body is manufactured by using the metal, an eddy current loss and a hysteresis loss at a high frequency wave may increase to cause serious damage of the material.

To reduce the loss of the material, a structure in which the metal powder is insulated from each other by a polymer may be applied. That is, sheets in which the metal powder and the polymer are mixed with each other are laminated to manufacture the body of the power inductor. Also, a predetermined base on which a coil pattern is formed is provided inside the body. That is, the coil pattern is formed on the predetermined base, and a plurality of sheets are laminated and compressed on upper and lower sides of the coil pattern to manufacture the power inductor.

The coil inductance may be proportional to magnetic permeability. Thus, to realize high inductance in unit volume, a material having high magnetic permeability may be required. Since magnetic permeability in the metal powder increases according to an increase in size of a particle, a particle having a large size may be used to realize the high magnetic permeability. However, the high-frequency loss may increase together with usable frequency-down conversion due to the increase of the particle size. This may be caused by the eddy current loss occurring by an increase of a surface area. The loss due to the surface eddy current may be converted into heat, and the efficiency of the inductor may be deteriorated by the decrease in magnetic permeability of the metal particle and the increase of the loss due to the heat loss. Thus, to prevent the efficiency of the high frequency from being deteriorated, it is necessary to reduce the particle size. However, when a particle having a small size is used, there is a limitation in implementing inductance due to low magnetic permeability that is capable of being expressed maximally. Therefore, it is essential to minimize a volume of a nonmagnetic material, which acts as a cause of reduction of the magnetic permeability, by increasing a filling rate of metal particles per unit volume.

PRIOR ART DOCUMENTS

Korean Patent Publication No. 2007-0032259

DISCLOSURE OF THE INVENTION

Technical Problem

The present disclosure provides a power inductor that is capable of improving magnetic permeability and thus improving inductance.

The present disclosure also provides a power inductor that is capable of improving magnetic permeability by using plurality of metal powder having different mean grain-size distribution.

The present disclosure also provides a power inductor that is capable of improving insulation between a coil pattern and a body.

Technical Solution

In accordance with an exemplary embodiment, a power inductor includes: a body including metal powder and a polymer; at least one base provided in the body; and at least one coil pattern disposed on at least one surface of the base, wherein the metal powder includes at least three metal powder of which middle values of grain-size distribution are different from each other.

The metal powder may include first metal powder of which the middle value of the grain-size distribution is 20 μm to 100 μm, second metal powder of which the middle value of the grain-size distribution is 2 μm to 20 μm, and third metal powder of which the middle value of the grain-size distribution is 1 μm to 10 μm.

50 wt % to 90 wt % of the first metal powder, 5 wt % to 25 wt % of the second metal powder, and 5 wt % to 25 wt % of the third metal powder with respect to 100 wt % of the metal powder may be contained.

At least one of the first to third metal powder may further include at least one metal power having a different middle value of the grain-size distribution.

The first to third metal powder may be made of an alloy containing Fe, and at least one of the first to third metal powder may have a different Fe content.

Each of the second and third metal powder may have the Fe content greater than that of the first metal powder.

The power inductor may further include fourth metal powder having a composition different from that of each of the first to third metal powder.

The first to third metal powder may contain Fe, Si, and Cr, and the fourth metal powder may not contain Si and Cr.

The second metal powder may have the Si content grater than that of the third metal powder and the Cr content less than that of the third metal powder.

At least one of the first to fourth metal powder may be crystalline, and the rest may be amorphous.

At least a region of the base may be removed, and the body may be filled into the removed region.

The base may have a curved surface that protrudes with respect to a side surface of the body by removing an entire outer area of the coil pattern.

The coil patterns disposed on one surface and the other surface of the base may have the same height that is higher 2.5 times than a thickness of the base.

The coil pattern may include a first plated layer disposed on the base and a second plated layer disposed to cover the first plated layer.

At least one region of the coil pattern may have a different width.

The power inductor may further include an insulation layer between the coil pattern and the body, wherein the insulation layer may be disposed at a uniform thickness on top and side surfaces of the coil pattern and have the same thickness as that of each of the top and side surfaces of the coil pattern on the base.

Advantageous Effects

In the power inductor in accordance with the exemplary embodiments, the body may be made of the metal powder and the polymer, and the at least three metal powder having the different mean grain-size distribution may be provided. Therefore, the magnetic permeability may be adjusted according to the variation in size of the metal powder.

In addition, the thermal conductive filler may be further provided in the body to well release the heat of the body to the outside, and thus, the reduction of the inductance due to the heating of the body may be prevented.

Also, since the parylene is applied on the coil pattern, the insulation layer having the uniform thickness may be formed on the coil pattern, and thus, the insulation between the body and the coil pattern may be improved.

Also, the at least two bases each of which has at least one surface on which the coil pattern having the coil shape is disposed may be provided in the body to form the plurality of coils within one body, thereby increasing the capacity of the power inductor.

BRIEF DESCRIPTION OF THE DRAWINGS

Exemplary embodiments can be understood in more detail from the following description taken in conjunction with the accompanying drawings, in which.

MODE FOR CARRYING OUT THE INVENTION

Hereinafter, specific embodiments will be described in detail with reference to the accompanying drawings. The present inventive concept may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
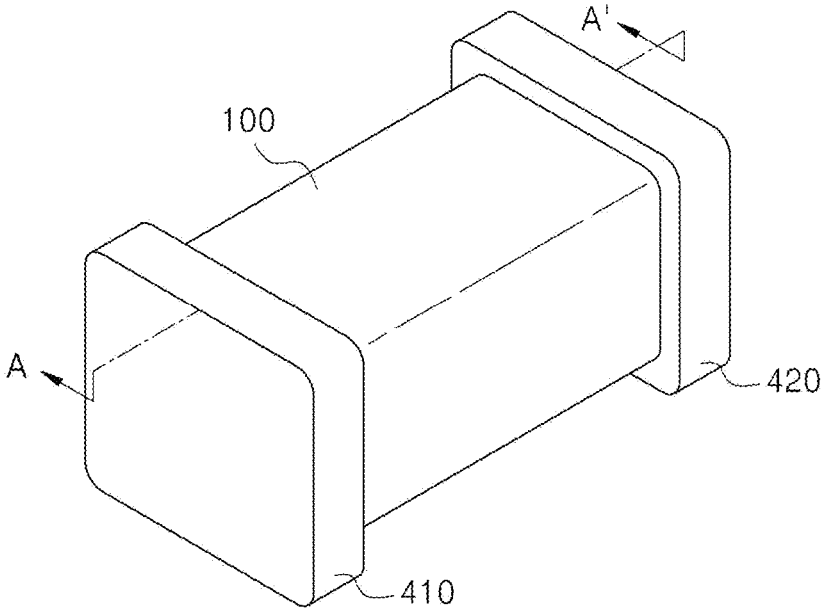
FIG. 1 is a combined perspective view of a power inductor in accordance with an exemplary embodiment.
Figure 2:
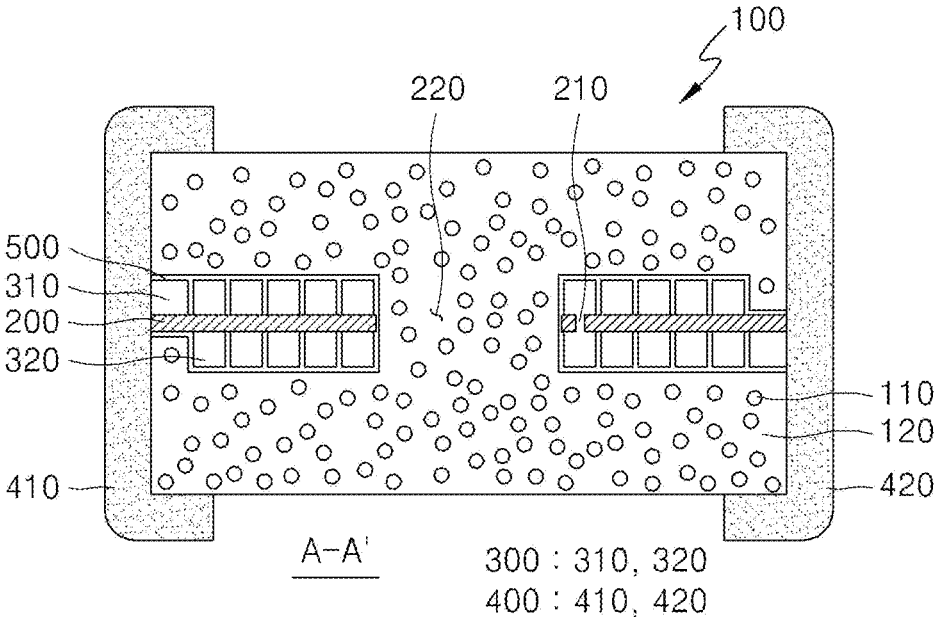
FIG. 2 is a cross-sectional view taken along line A-A' of FIG. 1.
Figure 3:
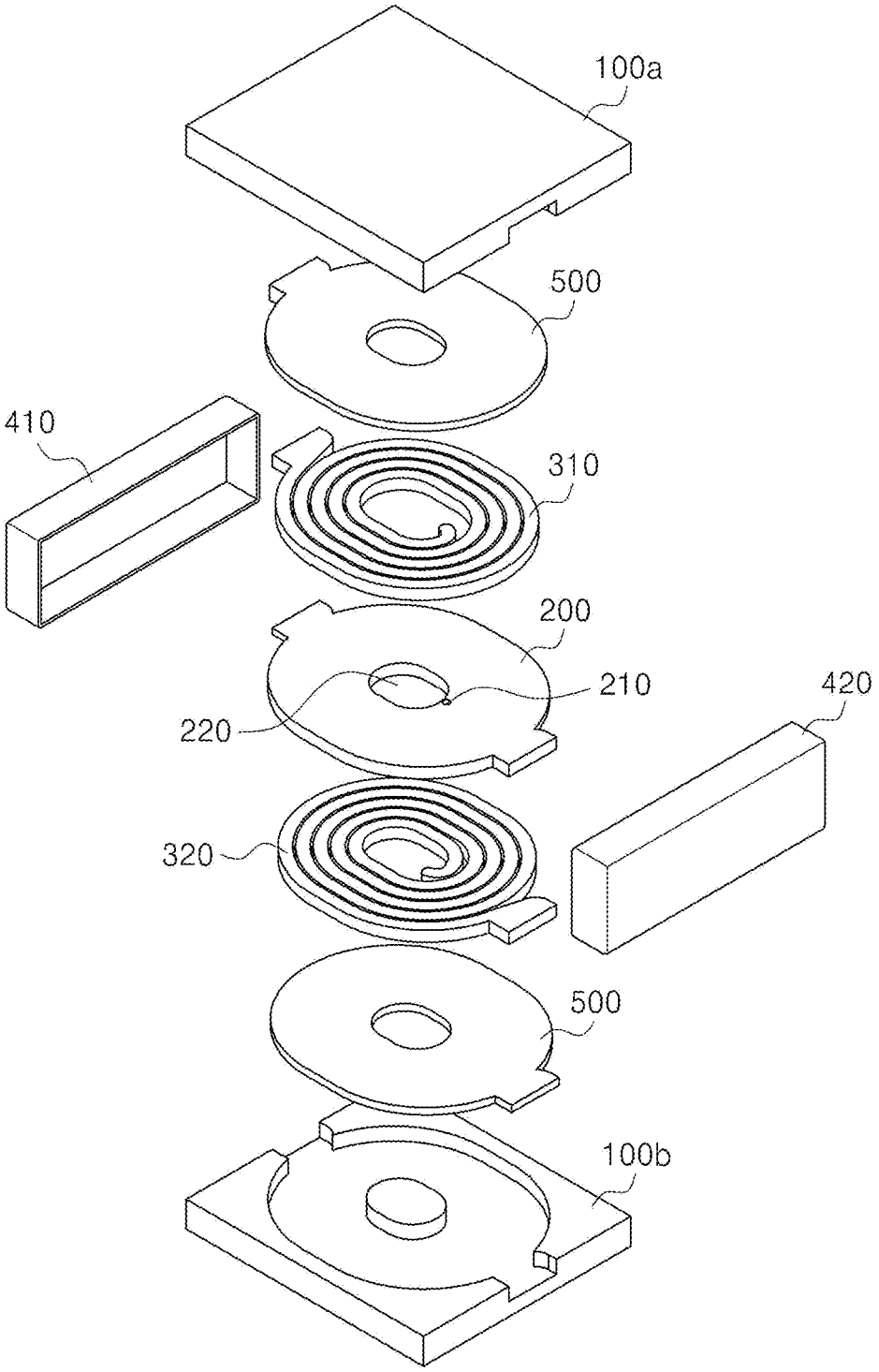
FIGS. 3 and 4 are an exploded perspective view and a partial plan view of the power inductor in accordance with an exemplary embodiment.
Figure 4:
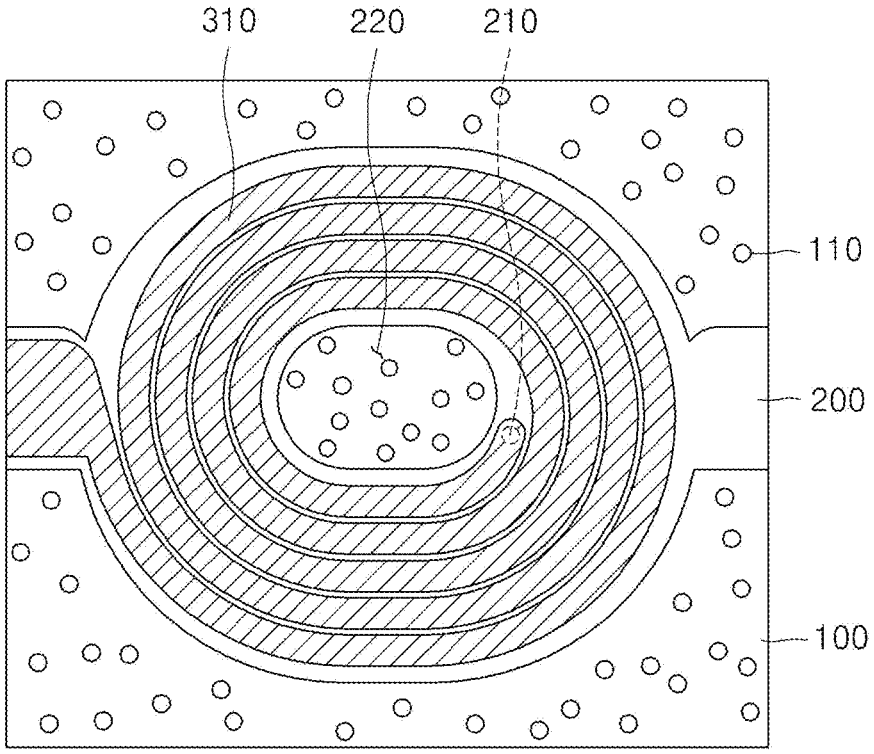
Figure 8:
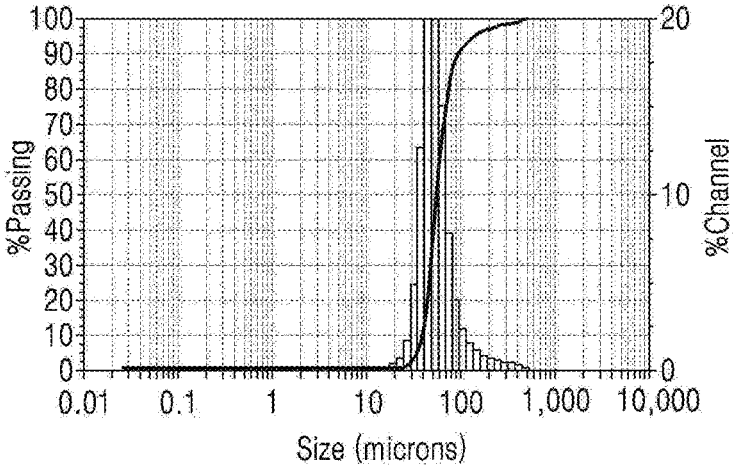
Figure 8:
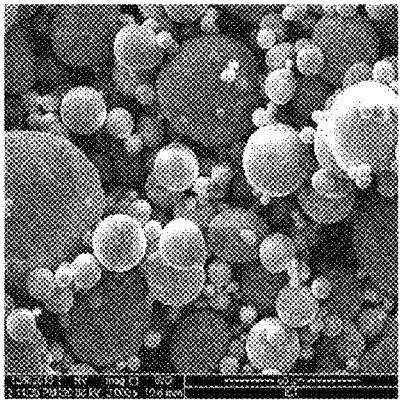
Figure 9:
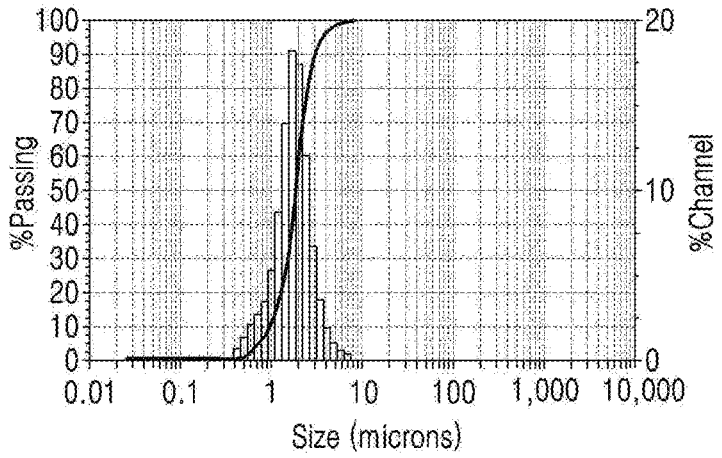
Figure 9:
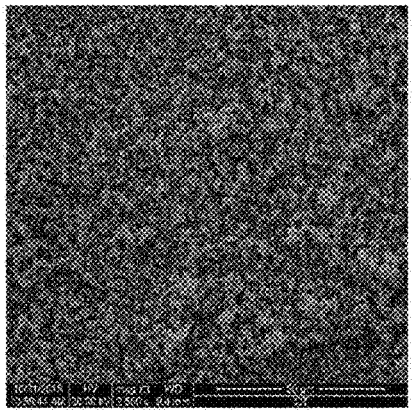
Figure 10:
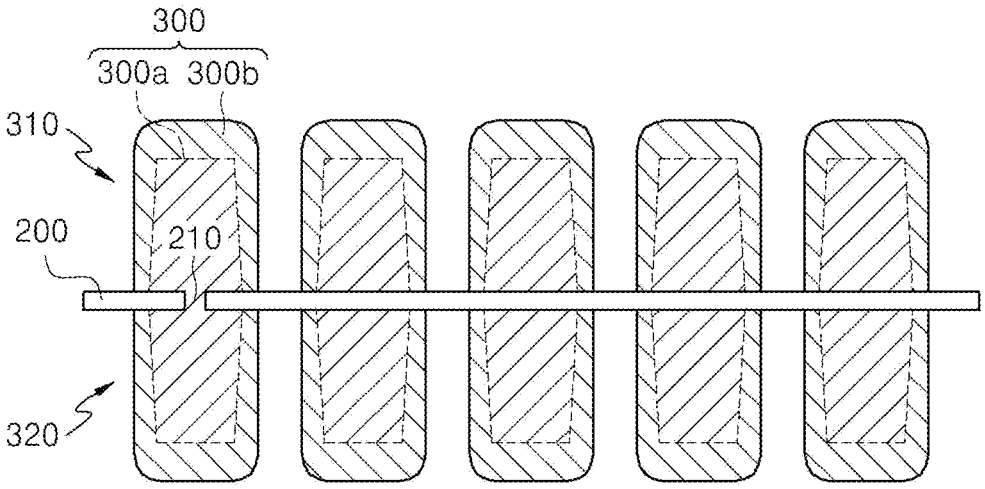
FIGS. 10 and 11 are cross-sectional views for explaining a shape of a coil pattern.
Figure 11:
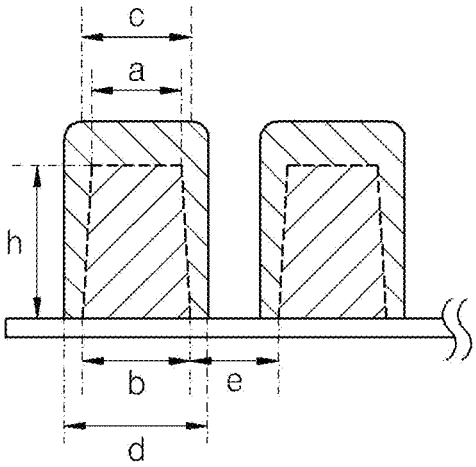

FIG. 1 is a combined perspective view of a power inductor in accordance with an exemplary embodiment, and FIG. 2 is a cross-sectional view taken along line A-A' of FIG. 1. Also, FIG. 3 is an exploded perspective view of the power inductor in accordance with an exemplary embodiment, and FIG. 4 is a plan view of a base and a coil pattern. Also, FIGS. 5 to 9 are grain-size distribution and an SEM photograph of metal powder used in the power inductor in accordance with an exemplary embodiment. Also, FIG. 10 is a cross-sectional view of the coil pattern in accordance with an exemplary embodiment, and FIG. 11 is a partial enlarged cross-sectional view of the coil pattern.

Referring to FIGS. 1 to 4, a power inductor in accordance with an exemplary embodiment may include a body 100 (100*a* and 100*b*), a base 200 provided in the body 100, coil patterns 300 (310 and 320) disposed on at least one surface of the base 200, and external electrodes 400 (410 and 420) disposed outside the body 100. Also, the power inductor may further include an insulation layer 500 disposed between the coil patterns 310 and 320 and the body 100. Also, although not shown, the power inductor may further include a surface modification member disposed on at least one surface of the body 100.

1. Body

The body 100 may have a hexahedral shape. Of course, the body 100 may have a polyhedral shape in addition to the hexahedral shape. The body 100 may include metal powder 110 and a polymer 120 and may further include a thermal conductive filler.

1.1. Metal Powder

Figure 5:
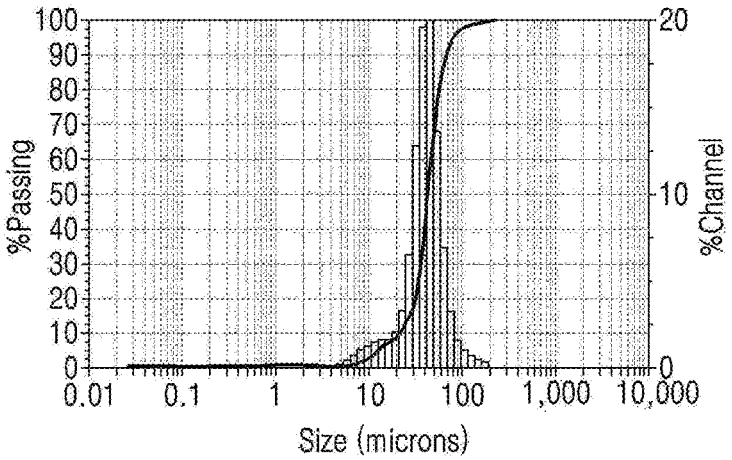
FIGS. 5 to 9 are grain-size distribution and an SEM photograph of metal powder used in the power inductor in accordance with an exemplary embodiment.
Figure 5:
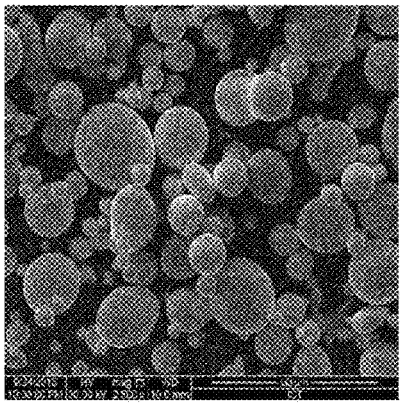
Figure 6:
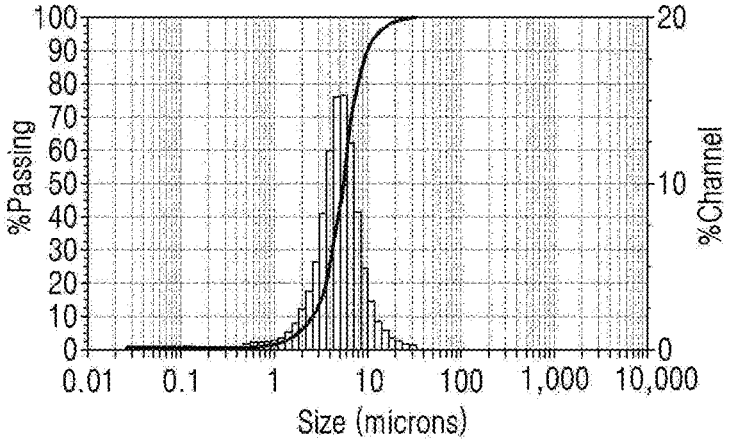
Figure 6:
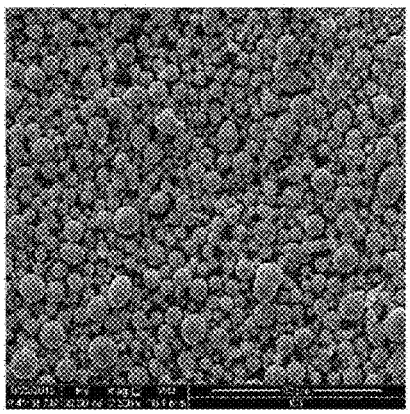
Figure 7:
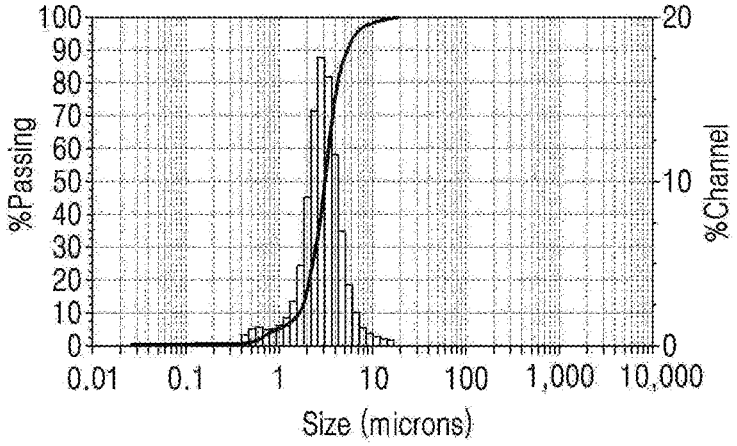
Figure 7:
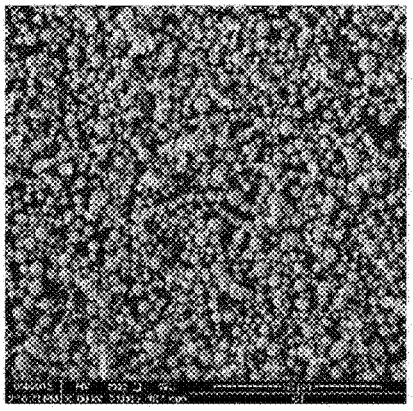

The metal powder 110 may have a mean size, i.e., a mean particle diameter of 1 μm to 100 μm. Also, one kind of particles having the same size or at least two kinds of particles may be used as the metal powder 110, or one kind of particles having a plurality of sizes or at least two kinds of particles may be used as the metal powder 110. For example, first metal particles having a mean particle diameter of 20 μm to 100 μm, second metal particles having a mean particle diameter of 2 μm to 20 μm, and third metal powder having a mean particle diameter of 1 μm to 10 μm may be mixed with each other to be used as the metal powder 110. That is, the metal powder 110 may include the first metal powder of which a mean value of particle sizes or a middle value D50 of grain-size distribution ranges from 20 μm to 100 μm as illustrated in FIG. 5, second metal powder of which a mean value of particle sizes or a middle value D50 of grain-size distribution ranges from 2 μm to 20 μm as illustrated in FIG. 6, and third metal powder of which a mean value of particle sizes or a middle value D50 of grain-size distribution ranges from 1 μm to 10 μm as illustrated in FIG. 7. Here, the first metal powder may have a particle size greater than that of the second metal powder, and the second metal powder may have a particle size greater than that of the third metal powder. That is, when a mean particle diameter of the first metal powder is C, a mean particle diameter of the second metal powder is B, and a mean particle diameter of the third metal powder is C, a ratio of A:B:C may be a ratio of 20 to 100:2 to 20:1 to 10. For example, a ratio of A:B:C may be a ratio of 20:1.5:1 or a ratio of 10:1.5:1. FIGS. 5 to 7 illustrate grain-size distribution and SEM photographs of the first to third metal powder. That is, (a) of FIGS. 5 to 7 illustrate graphs of the grain-size distribution of the first to third metal powder, and (b) of FIGS. 5 to 7 illustrate SEM photographs of the first to third metal powder having the grain-size distribution illustrated in (a) of FIGS. 5 to 7. Here, the first, second, and third metal powder may be powder made of the same material or powder made of materials different from each other. Also, a mixing ratio of the first, second, and third metal powder may be 5 to 9:0.5 to 2.5:0.5 to 2.5, preferably, 7:1:2. That is, 50 wt % to 90 wt % of the first metal powder, 5 wt % to 25 wt % of the second metal powder, and 5 wt % to 25 wt % of the third metal powder with respect to 100 wt % of the metal powder 110 may be mixed. Here, an amount of first metal powder may be greater than that of second metal powder, and an amount of second metal powder may be less than or equal to that of third metal powder. Preferably, 70 wt % of the first metal powder, 10 wt % of the second metal powder, and 20 wt % of the third metal powder with respect to 100 wt % of the metal powder 110 may be mixed.

Also, each of the first to third metal powder may further include at least two metal powder different from each other. That is, the first metal powder may include at least two metal powder having different sizes, for example, first-1 metal powder having a mean particle diameter of 50 μm and first-2 metal powder having a mean particle diameter of 30 on. Also, the first metal powder may further include first-3 metal powder having a mean particle diameter of 40 on. Of course, each of the second and third metal powder may further include metal powder having at least two sizes. The first to third metal powder may be prepared by performing sieving. For example, the first metal powder may include at least two metal powder having at least two mean sizes, and also, at least one metal powder may be prepared by performing the sieving. That is, the metal powder may be filtered by using a mesh having an opening with a predetermined size, i.e., a sieve so that metal powder having a size equal to or grater than that of the opening is used. For example, the metal powder may be sieved by using a sieve having an opening with a size of 50 μm, and thus, the metal powder having a size equal to or grater than that of 50 μm may be used. (a) of FIG. 8 illustrates grain-size distribution of the metal powder of which the middle value D50 of the grain-size distribution is a size of 55 μm, and (b) of FIG. 8 illustrates an SEM photograph of the metal powder. For example, in case of the first metal powder including the first-1 metal powder having a mean particle diameter of 40 μm to 55 μm and the first-2 metal powder having a mean particle diameter of 20 μm to 30 μm, the first-1 metal powder may be prepared by performing the sieving, and the first-2 metal powder may be prepared without performing the sieving. The first-1 metal powder in which the sieving is performed and the first-2 metal powder in which the sieving is not performed may be, for example, mixed at a ratio of 0 to 8:0 to 8. That is, 0 wt % to 80 wt % of the first-1 metal powder, in which the sieving is performed, and 80 wt % to 0 wt % of the first-2 metal powder, in which the sieving is not performed, with respect to 100 wt % of the metal powder may be mixed. Here, the sum of the contents of the first-1 metal powder and the first-2 metal powder may be 80 wt %, and the remaining content of the metal powder may be filled with the second and third metal powder.

Each of the first, second, and third metal powder may include a metal material including iron (Fe), for example, at least one metal selected from the group consisting of Fe—Ni, Fe—Ni—Si, Fe—Al—Si, and Fe—Al—Cr. For example, the first, second, and third metal powder may contain 80% or more of Fe and other materials. That is, 80 wt % of Fe and 20 wt % of other materials except for Fe with respect to 100 wt % of the metal powder may be contained in the metal powder. Also, at least one of the first, second, and third metal powder may have a different mixing ratio of the materials. For example, each of the first, second, and third metal powder may be an alloy of Fe, Si, and Cr. Here, a Fe content of the first metal powder is may be less or greater than a Fe content of each of the second and third metal powder. For example, Fe, Si, and Cr may be mixed at a ratio of 80 to 90:5 to 10:1 to 5 in the metal powder. Also, Fe, Si, and Cr may be mixed at a ratio of 90 to 95:4 to 6:2 to 4 in each of the second and third metal powder. Here, the ratio may be a unit of wt %. That is, Fe, Si, and Cr may be respectively contained at ratios of 80 wt % to 90 wt %, 5 wt % to 10 wt %, and 1 wt % to 5 wt % with respect to 100 wt % of the first metal powder, and the remaining material may be impurities. Also, Fe, Si, and Cr may be respectively contained at ratios of 90 wt % to 95 wt %, 4 wt % to 6 wt %, and 2 wt % to 4 wt % with respect to 100 wt % of the first metal powder, and the remaining material may be impurities. That is, in each of the first, second, and third metal powder, the Fe content may be greater than the Si content, and the Si content may be greater than the Cr content. Also, in the second and third metal powder, the contents of Fe, Si, and Cr may be different from each other. For example, the second metal powder may have the Fe and Si contents greater than those of the third metal powder and the Cr content less than that of the third metal powder.

Also, the metal powder may further include fourth metal powder containing iron and having a composition different from that of each of the first to third metal powder. For example, the fourth metal powder may have a composition containing Fe, C, O, P, and the like. Here, Fe is contained at a ratio of 85% to 90%, and the remaining material may be contained at a ratio of 10% to 15%. That is, when the mixture of Fe, C, O, and P has a content of 100 wt %, Fe may have a content of 85 wt % to 90 wt %, and the remaining material may have a content of 10 wt % to 15 wt %. (a) of FIG. 9 illustrates grain-size distribution of the fourth metal powder, and (b) of FIG. 9 illustrates an SEM photograph of the grain-size distribution. Thus, the metal powder 110 may include the first to third metal powder, the first, second, and fourth metal powder, or the first to fourth metal powder.

Here, the fourth metal powder may have the same size and content as the third metal powder or may have a size and content less than those of the third metal powder. That is, when the metal powder 110 includes the fourth metal powder instead of the third metal powder, i.e., includes first, second, and fourth metal powder, the fourth metal powder may have a mean particle diameter of 1 μm to 10 μm and be mixed at a ratio of 5 wt % to 25 wt %. However, when the metal powder 110 includes the first to fourth metal powder, the fourth metal powder may have a mean particle diameter, i.e., a mean value D50 of grain-size distribution may be, for example, 0.5 μm to 5 μm and mixed at a ratio of 1 wt % to 10 wt %. That is, 50 wt % to 90 wt % of the first metal powder, 5 wt % to 25 wt % of the second metal powder, 5 wt % to 25 wt % of the third metal powder, and 1 wt % to 10 wt % of the fourth metal powder with respect to 100 wt % of the metal powder 110 including the first to fourth metal powder may be contained. At least one of the first to fourth metal powder may be crystalline, and the remaining material may be amorphous. Alternatively, at least one of the first to fourth metal powder may be amorphous, and the remaining material may be crystalline. For example, the first to third metal powder may be amorphous, and the fourth metal powder may be crystalline.

When the metal powder 110 includes at least two kinds of metal powder 110 having sizes different from each other, the body 100 may increase in filling rate and thus be maximized in capacity. For example, in case of using the metal powder having the size of 30 μm, a pore may be generated between the metal powder, and thus, the filling rate may be reduced. However, the metal powder having the size of 3 μm may be mixed between the metal powder having the size of 30 μm to increase the filling rate of the metal powder within the body 110. Also, as described above, the at least two kinds of metal powder 110 having the different sizes may be used to adjust the magnetic permeability according to the sizes of the metal powder. That is, as the metal powder having a large mean particle diameter may be used, and the mixing ratio increases, the magnetic permeability may increase. In addition, the sieving may be performed to more improve the magnetic permeability.

Also, a surface of the metal powder 110 may be coated with a magnetic material, and the magnetic material may have magnetic permeability different from that of the metal powder 110. For example, the magnetic material may include a metal oxide magnetic material. The metal oxide magnetic material may include at least one selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material. That is, the magnetic material applied to the surface of the metal powder 110 may include metal oxide including iron and have magnetic permeability greater than that of the metal powder 110. Since the metal powder 110 has magnetism, when the metal powder 110 come into contact with each other, the insulation therebetween may be broken to cause short-circuit. Thus, the surface of the metal powder 110 may be coated with at least one insulation material. For example, the surface of the metal powder 110 may be coated with oxide or an insulative polymer material such as parylene, preferably, the surface of the metal powder 110 may be coated with the parylene. The parylene may be coated to a thickness of 1 μm to 10 μm. Here, when the parylene is formed to a thickness of 1 μm or less, an insulation effect of the metal powder 110 may be deteriorated. When the parylene is formed to a thickness exceeding 10 μm, the metal powder 110 may increase in size to reduce distribution of the metal powder 110 within the body 100, thereby deteriorating the magnetic permeability. Also, the surface of the metal powder 110 may be coated with various insulative polymer materials in addition to the parylene. The oxide applied to the metal powder 110 may be formed by oxidizing the metal powder 110, and the metal powder 110 may be coated with at least one selected from $TiO_2$, $SiO_2$, $ZrO_2$, $SnO_2$, NiO, ZnO, CuO, CoO, MnO, MgO, $Al_2O_3$, $Cr_2O_3$, $Fe_2O_3$, $B_2O_3$, and $Bi_2O_3$. Here, the metal powder 110 may be coated with oxide having a double structure, for example, may be coated with a double structure of the oxide and the polymer material. Alternatively, the surface of the metal powder 110 may be coated with an insulation material after being coated with the magnetic material. Since the surface of the metal powder 110 is coated with the insulation material, the short-circuit due to the contact between the metal powder 110 may be prevented. Here, when the metal powder 100 is coated with the oxide and the insulation polymer or doubly coated with the magnetic material and the insulation material, the coating material may be coated to a thickness of 1 μm to 10 μm.

1.2. Polymer

The polymer 120 may be mixed with the metal powder 110 to insulate the metal powder 110 from each other. That is, the metal powder 110 may increase in eddy current loss at a high frequency, and thus, in order to reduce the material loss, the polymer 120 may be provided to insulate the metal powder 110 from each other. The polymer 120 may include at least one polymer selected from the group consisting of epoxy, polyimide, and liquid crystalline polymer (LCP), but is not limited thereto. Also, the polymer 120 may be made of a thermosetting resin to provide insulation between the metal powder 110. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, an urethane modified epoxy resin), a rubber modified epoxy resin, and a DCPD type epoxy resin. Here, the polymer 120 may be contained at a content of 2.0 wt % to 5.0 wt % with respect to 100 wt % of the metal powder 110. However, if the content of the polymer 120 increases, a volume fraction of the metal powder 110 may be reduced, and thus, it is difficult to properly realize an effect in which a saturation magnetization value increases. Thus, the magnetic permeability of the body 100 may be deteriorated. On the other hand, if the content of the polymer 120 decreases, a strong acid solution or a strong alkali solution that is used in a process of manufacturing the inductor may be permeated inward to reduce inductance properties. Thus, the polymer 120 may be contained within a range in which the saturation magnetization value and the inductance of the metal powder 110 are not reduced.

1.2. Thermal Conductive Filler

The body 100 may include a thermal conductive filler (not shown) to solve the limitation in which the body 100 is heated by external heat. That is, the metal powder 110 of the body 100 may be heated by external heat, and thus, the thermal conductive filler may be provided to easily release the heat of the metal powder 110 to the outside. The thermal conductive filler may include at least one selected from the group consisting of MgO, AlN, carbon-based materials, but is not limited thereto. Here, the carbon-based material may include carbon and have various shapes, for example, may include graphite, carbon black, graphene, and the like. Also, the thermal conductive filler may be contained at a content of 0.5 wt % to 3 wt % with respect to 100 wt % of the metal powder 110. When the thermal conductive filler has a content less than the above-described range, it may be difficult to obtain a heat releasing effect. On the other hand, when the thermal conductive filler has a content exceeding the above-described range, a content of the metal powder 110 may be reduced to deteriorate the magnetic permeability of the body 100. Also, the thermal conductive filler may have a size of, for example, 0.5 μm to 100 μm. That is, the thermal conductive filler may have the same size as the metal powder 110 or a size greater or less than that of the metal powder 110. The heat releasing effect may be adjusted in accordance with a size and content of the thermal conductive filler. For example, the more the size and content of the thermal conductive filler increase, the more the heat releasing effect may increase. The body 100 may be manufactured by laminating a plurality of sheets, which are made of a material including the metal powder 110, the polymer 120, and the thermal conductive filler. Here, when the plurality of sheets are laminated to manufacture the body 100, the thermal conductive fillers of the sheets may have contents different from each other. For example, the more the thermal conductive filler is away upward and downward from the center of the base 200, the more the content of the thermal conductive filler within the sheet may increase. Also, the body 100 may be manufactured by various methods such as a method of printing of paste, which is made of the metal powder 110, the polymer 120, and the thermal conductive filler, at a predetermined thickness and a method of pressing the paste into a frame. Here, the number of laminated sheet or the thickness of the paste printed to the predetermined thickness so as to form the body 100 may be determined in consideration of electrical characteristics such as an inductance required for the power inductor. The body 100*a* and 100*b* disposed on upper and lower portions of the base 200 with the base 200 therebetween may be connected to each other through the base 200. That is, at least a portion of the base 200 may be removed, and then a portion of the body 100 may be filled into the removed portion of the base 200. Since at least a portion of the base 200 is removed, and the body 100 is filled into the removed portion, the base 200 may be reduced in surface area, and a rate of the body 100 in the same volume may increase to improve the magnetic permeability of the power inductor.

2. Base

The base 200 may be provided in the body 100. For example, the base 200 may be provided in the body 100 in a long axis direction of the body 100, i.e., a direction of the external electrode 400. Also, at least one base 200 may be provided. For example, at least two bases 200 may be spaced a predetermined distance from each other in a direction perpendicular to a direction in which the external electrode 400 is disposed, for example, in a vertical direction. Of course, at least two bases 200 may be arranged in the direction in which the external electrode 400 is disposed. The base 200 may be provided in a shape in which metal foil is attached to each of upper and lower portions of a base having a predetermined thickness. Here, the base may include, for example, glass reinforced fibers, plastic, metal magnetic materials, and the like. That is, a copper clad lamination (CCL) in which the copper foil is bonded to the glass reinforced fiber may be used as the base 200, or the copper foil may be bonded to the plastic such as polyimide or bonded to a metal magnetic material to manufacture the base 200. Here, the base 200 may be manufactured by using the metal magnetic body to improve the magnetic permeability and facilitate capacity realization. That is, the CCL is manufactured by bonding the copper foil to the glass reinforced fiber. Since the CCL has the magnetic permeability, the power inductor may be deteriorated in magnetic permeability. However, when the metal magnetic body is used as the base 200, since the metal magnetic body has the magnetic permeability, the power inductor may not be deteriorated in magnetic permeability. The base 200 using the metal magnetic body may be manufactured by bonding copper foil to the base having a plate shape having a predetermined thickness, which is made of a metal containing iron, e.g., at least one metal selected from the group consisting of Fe—Ni, Fe—Ni—Si, Fe—Al—Si, and Fe—Al—Cr. That is, an alloy made of at least one metal containing iron may be manufactured in a plate shape having a predetermined thickness, and copper foil may be bonded to at least one surface of the metal plate to manufacture the base 200.

Also, at least one conductive via 210 may be defined in a predetermined area of the base 200. The coil patterns 310 and 320 disposed on the upper and lower portions of the base 200 may be electrically connected to each other through the conductive via 210. A via (not shown) passing through the base 200 in a thickness direction of the base 200 may be formed in the base 200 and then filled through a plating process during the formation of the coil pattern 300 to form the conductive via 210, or the conductive via 210 may be formed by filling conductive paste into the via. However, when the coil pattern 300 is formed, it is preferable to fill the via through the plating. Here, at least one of the coil patterns 310 and 320 may be grown from the conductive via 210, and thus, at least one of the coil patterns 310 and 320 may be integrated with the conductive via 210. Also, at least a portion of the base 200 may be removed. That is, at least a portion of the base 200 may be removed or may not be removed. As illustrated in FIGS. 3 and 4, an area of the base 200, which remains except for an area overlapping the coil patterns 310 and 320, may be removed. For example, the base 200 may be removed to form the through-hole 220 inside the coil patterns 310 and 320 each of which has a spiral shape, and the base 200 outside the coil patterns 310 and 320 may be removed. That is, the base 200 may have a shape along an outer appearance of each of the coil patterns 310 and 320, e.g., a racetrack shape, and an area of the base 200 facing the external electrode 400 may have a linear shape along a shape of an end of each of the coil patterns 310 and 320. Thus, the outside of the base 200 may have a shape that is curved with respect to an edge of the body 100. As illustrated in FIG. 4, the body 100 may be filled into the removed portion of the base 200. That is, the upper and lower bodies 100*a* and 100*b* may be connected to each other through the removed region including the through-hole 220 of the base 200. When the base 200 is manufactured using the metal magnetic material, the base 200 may come into contact with the metal powder 110 of the body 100. To solve the above-described limitation, the insulation layer 500 such as parylene may be disposed on a side surface of the base 200. For example, the insulation layer 500 may be disposed on a side surface of the through-hole 220 and an outer surfaces of the base 200. The base 200 may have a width greater than that of each of the coil patterns 310 and 320. For example, the base 200 may remain with a predetermined width in a directly downward direction of the coil patterns 310 and 320. For example, the base 200 may protrude by a height of approximately 0.3 μm from each of the coil patterns 310 and 320. Since the base 200 outside and inside the coil patterns 310 and 320 is removed, the base 200 may have a cross-sectional area less than that of the body 100. For example, when the cross-sectional area of the body 100 is defined as a value of 100, the base 200 may have an area ratio of 40 to 80. If the area ratio of the base 200 is high, the magnetic permeability of the body 100 may be reduced. On the other hand, if the area ratio of the base 200 is low, the formation area of the coil patterns 310 and 320 may be reduced. Thus, the area ratio of the base 200 may be adjusted in consideration of the magnetic permeability of the body 100 and a line width and turn number of each of the coil patterns 310 and 320.

3. Coil Pattern

The coil patterns 300 (310 and 320) may be disposed on at least one surface, preferably, both surfaces of the base 200. Each of the coil patterns 310 and 320 may be formed in a spiral shape on a predetermined area of the base 200, e.g., outward from a central portion of the base 200, and the two coil patterns 310 and 320 disposed on the base 200 may be connected to each other to form one coil. That is, each of the coil patterns 310 and 320 may have a spiral shape from the outside of the through-hole 220 defined in the central portion of the base 200. Also, the coil patterns 310 and 320 may be connected to each other through the conductive via 210 provided in the base 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. An end of each of the coil patterns 310 and 320 may extend outward in a linear shape and also extend along a central portion of a short side of the body 100. Also, an area of each of the coil patterns 310 and 320 coming into contact with the external electrode 400 may have a width greater than that of the other area as illustrated in FIGS. 3 and 4. Since a portion of each of the coil patterns 310 and 320, i.e., a lead-out part has a relatively wide width, a contact area between each of the coil patterns 310 and 320 and the external electrode 400 may increase to reduce resistance. Alternatively, each of the coil patterns 310 and 320 may extend in a width direction of the external electrode 400 from one area on which the external electrode 400 is disposed. Here, the lead-out part that is led out toward a distal end of each of the coil patterns 310 and 320, i.e., the external electrode 400 may have a linear shape toward a central portion of the side surface of the body 100.

The coil patterns 310 and 320 may be electrically connected to each other by the conductive via 210 provided in the base 200. The coil patterns 310 and 320 may be formed through methods such as, for example, thick-film printing, coating, deposition, plating, and sputtering. Here, the coil patterns 310 and 320 may preferably formed through the plating. Also, each of the coil patterns 310 and 320 and the conductive via 210 may be made of a material including at least one of silver (Ag), copper (Cu), and a copper alloy, but is not limited thereto. When the coil patterns 310 and 320 are formed through the plating process, a metal layer, e.g., a cupper layer is formed on the base 200 through the plating process and then patterned through a lithography process. That is, the copper layer may be formed by using the copper foil disposed on the surface of the base 200 as a seed layer and then patterned to form the coil patterns 310 and 320. Alternatively, a photosensitive pattern having a predetermined shape may be formed on the base 200, and the plating process may be performed to grow a metal layer from the exposed surface of the base 200, thereby forming the coil patterns 310 and 320, each of which has a predetermined shape. The coil patterns 310 and 320 may be formed with a multilayer structure. That is, a plurality of coil patterns may be further disposed above the coil pattern 310 disposed on the upper portion of the base 200, and a plurality of coil patterns may be further disposed below the coil pattern 320 disposed on the lower portion of the base 200. When the coil patterns 310 and 320 are formed with the multilayer structure, the insulation layer may be disposed between a lower layer and an upper layer. Then, the conductive via (not shown) may be formed in the insulation layer to connect the multilayered coil patterns to each other. Each of the coil patterns 310 and 320 may have a height that is greater 2.5 times than a thickness of the base 200. For example, the base may have a thickness of 10 μm to 50 μm, and each of the coil patterns 310 and 320 may have a height of 50 μm to 300 μm.

Also, the coil patterns 310 and 320 in accordance with an exemplary embodiment may have a double structure. That is, as illustrated in FIG. 10, a first plated layer 300*a* and a second plated layer 300*b* configured to cover the first plated layer 300*a* may be provided. Here, the second plated layer 300*b* may be disposed to cover top and side surfaces of the first plated layer 300*a*. Also, the second plated layer 300*b* may be formed so that the top surface of the first plated layer 300*a* has a thickness greater than that of the side surface of the first plated layer 300*a*. The side surface of the first plated layer 300*a* may have a predetermined inclination, and a side surface of the second plated layer 300*b* may have an inclination less than that of the side surface of the first plated layer 300*a*. That is, the side surface of the first plated layer 300*a* may have an obtuse angle from the surface of the base 200 outside the first plated layer 300*a*, and the second plated layer 300*b* has an angle less than that of the first plated layer 300*a*, preferably, a right angle. As illustrated in FIG. 11, a ratio of a width a of a top surface to a width b of a bottom surface of the first plated layer 300*a* may be 0.2:1 to 0.9:1, preferably, a ratio of a:b may be 0.4:1 to 0.8:1. Also, a ratio of a width b to a height h of the bottom surface of the first plated layer 300*a* may be 1:0.7 to 1:4, preferably, 1:1 to 1:2. That is, the first plated layer 300*a* may have a width that gradually decreases from the bottom surface to the top surface. Thus, the first plated layer 300*a* may have a predetermined inclination. An etching process may be performed after a primary plating process so that the first plated layer 300*a* has a predetermined inclination. Also, the second plated layer 300*b* configured to cover the first plated layer 300*a* may have an approximately rectangular shape in which a side surface is vertical, and an area rounded between the top surface and the side surface is less. Here, the second plated layer 300*b* may be determined in shape in accordance with a ratio of the width a of the top surface to the width b of the bottom surface of the first plated layer 300*a*, i.e., a ratio of a:b. For example, the more the ratio (a:b) of the width a of the top surface to the width b of the bottom surface of the first plated layer 300*a* increases, the more a ratio of a width c of the top surface to a width d of the bottom surface of the second plated layer 300*b* increases. However, when the ratio (a:b) of the width a of the top surface to the width b of the bottom surface of the first plated layer 300*a* exceeds 0.9:1, the width of the top surface of the second plated layer 300*b* may be more widened than that of the top surface of the second plated layer 300*b*, and the side surface may have an acute angle with respect to the base 200. Also, when the ratio (a:b) of the width a of the top surface to the width b of the bottom surface of the first plated layer 300*a* is below 0:2:1, the second plated layer 300*b* may be rounded from a predetermined area to the top surface. Thus, the ratio of the top surface to the bottom surface of the first plated layer 300*a* may be adjusted so that the top surface has the wide width and the vertical side surface. Also, a ratio of the width b of the bottom surface of the first plated layer 300*a* to the width d of the bottom surface of the second plated layer 300*b* may be 1:1.2 to 1:2, and a distance between the width b of the bottom surface of the first plated layer 300*a* and the adjacent first plated layer 300*a* may have a ratio of 1.5:1 to 3:1. Alternatively, the second plated layers 300*b* may not come into contact with each other. A ratio (c:d) of the widths of the top surface to the bottom surface of the coil patterns 300 constituted by the first and second plated layers 300*a* and 300*b* may be 0.5:1 to 0.9:1, preferably, 0.6:1 to 0.8:1. That is, a ratio of widths of the top surface to the bottom surface of an outer appearance of the coil pattern 300, i.e., an outer appearance of the second plated layer 300*b* may be 0.5:1 to 0.9:1. Thus, the coil pattern 300 may have a ratio of 0.5 or less with respect to an ideal rectangular shape in which the rounded area of the edge of the top surface has a right angle. For example, the coil pattern 300 may have a ratio ranging from 0.001 to 0.5 with respect to the ideal rectangular shape in which the rounded area of the edge of the top surface has the right angle. Also, the coil pattern 300 in accordance with an exemplary embodiment may have a relatively low resistance variation when compared to a resistance variation of the ideal rectangular shape. For example, if the coil pattern having the ideal rectangular shape has resistance of 100, resistance the coil pattern 300 may be maintained between values of 101 to 110. That is, the resistance of the coil pattern 300 may be maintained to approximately 101% to approximately 110% in accordance with the shape of the first plated layer 300*a* and the shape of the second plated layer 300*b* that varies in accordance with the shape of the first plated layer 300*a* when compared to the resistance of the ideal coil pattern having the rectangular shape. The second plated layer 300*b* may be formed by using the same plating solution as the first plated layer 300*a*. For example, the first and second plated layers 300*a* and 300*b* may be formed by using a plating solution that is based on copper sulfate and sulfuric acid. Here, the plating solution may be improved in plating property of a product by adding chlorine (Cl) having a ppm unit and an organic compound. The organic compound may be improved in uniformity and throwing powder of the plated layer and gloss characteristics by using a carrier and a polish.

Also, the coil pattern 300 may be formed by laminating at least two plated layers. Here, each of the plated layers may have a vertical side surface and be laminated in the same shape and at the same thickness. That is, the coil pattern 300 may be formed on a seed layer through a plating process. For example, three plated layers may be laminated on the seed layer to form the coil pattern 300. The coil pattern 300 may be formed through an anisotropic plating process and have an aspect ratio of approximately 2 to approximately 10.

Also, the coil pattern 300 may have a shape of which a width gradually increases from the innermost circumferential portion to the outermost circumferential portion thereof. That is, the coil pattern 300 having the spiral shape may include n patterns from the innermost circumference to the outermost circumference. For example, when four patterns are provided, the patterns may have widths that gradually increase in order of a first pattern that is disposed on the innermost circumference, a second pattern, a third pattern, and a fourth pattern that is disposed on the outermost circumference. For example, when the width of the first pattern is 1, the second pattern may have a ratio of 1 to 1.5, the third pattern may have a ratio of 1.2 to 1.7, and the fourth pattern may have a ratio of 1.3 to 2. That is, the first to fourth patterns may have a ratio of 1:1 to 1.5:1.2 to 1.7:1.3 to 2. That is, the second pattern may have a width equal to or greater than that of the first pattern, the third pattern may have a width greater than that of the first pattern and equal to or greater than that of the second pattern, and the fourth pattern may have a width greater than that of each of the first and second patterns and equal to or greater than that of the third pattern. The seed layer may have a width that gradually increases from the innermost circumference to the outermost circumference so that the coil pattern has the width that gradually increases from the innermost circumference to the outermost circumference. Also, widths of at least one region of the coil pattern in a vertical direction may be different from each other. That is, a lower end, an intermediate end, and an upper end of the at least one region may have widths different from each other.

4. External Electrode

The external electrodes 410 and 420 (400) may be disposed on two surface facing each other of the body 100. For example, the external electrodes 400 may be disposed on two side surfaces of the body 100, which face each other in a longitudinal direction. The external electrodes 400 may be electrically connected to the coil patterns 310 and 320 of the body 100. Also, the external electrodes 400 may be disposed on the two side surfaces of the body 100 to come into contact with the coil patterns 310 and 320 at central portions of the two side surfaces, respectively. That is, an end of each of the coil patterns 310 and 320 may be exposed to the outer central portion of the body 100, and each of the external electrodes 400 may be disposed on the side surface of the body 100 and then connected to the end of each of the coil patterns 310 and 320. Alternatively, the external electrodes 400 may be disposed on portions of the two side surfaces facing each other of the body 100. The external electrodes 400 may be formed by immersing the body 100 into the conductive paste or formed on both ends of the body 100 through various methods such as printing, deposition, plating, and sputtering. Each of the external electrodes 400 may be made of a metal having electrical conductivity, e.g., at least one metal selected from the group consisting of gold, silver, platinum, copper, nickel, palladium, and an alloy thereof. Also, each of the external electrodes 400 may further include a nickel-plated layer (not shown) and a tin-plated layer (not shown). For example, the external electrode 400 may be formed by laminating a cupper layer, an Ni-plated layer, and an Sn- or Sn/Ag-plated layer. Also, the external electrode 400 may be formed by mixing, for example, multicomponent glass frit using $Bi_2O_3$ or $SiO_2$ of 0.5% to 20% as a main component with metal powder. Here, the mixture of the glass frit and the metal powder may be manufactured in the form of paste and applied to the two surface of the body 100. As described above, since the glass frit is contained in the external electrode 400, adhesion force between the external electrode 400 and the body 100 may be improved, and a contact reaction between the coil pattern 300 and the external electrode 400 may be improved. Also, after the conductive paste containing glass is applied, at least one plated layer may be disposed on the conductive paste to form the external electrode 400. That is, the metal layer containing the glass may be provided, and the at least one plated layer may be disposed on the metal layer to form the external electrode 400. For example, in the external electrode 400, after the layer containing the glass frit and at least one of Ag and Cu is formed, electroplating or electroless plating may be performed to successively form the Ni-plated layer and the Sn-plated layer. Here, the Sn-plated layer may have a thickness equal to or greater than that of the Ni-plated layer. The external electrode 400 may have a thickness of 2 μm to 100 μm. Here, the Ni-plated layer may have a thickness of 1 μm to 10 μm, and the Sn or Sn/Ag-plated layer may have a thickness of 2 μm to 10 μm.

5. Insulation Layer

Figure 12:
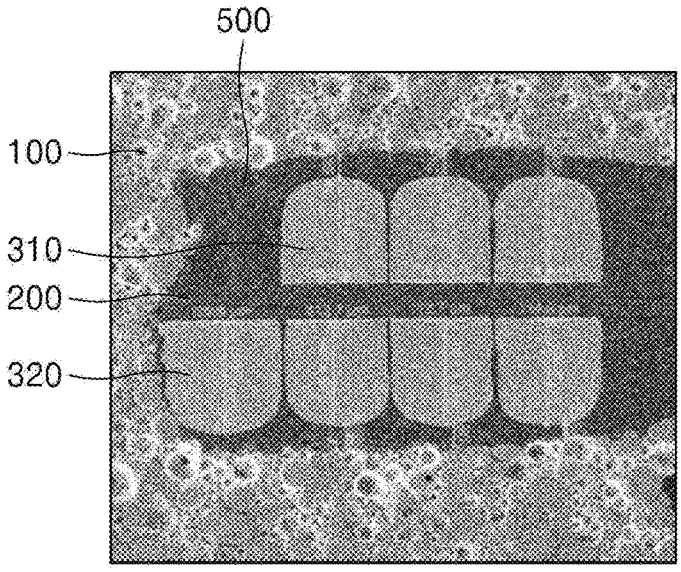
FIGS. 12 and 13 are cross-sectional photographs of the power inductor depending on materials of an insulation layer.
Figure 13:
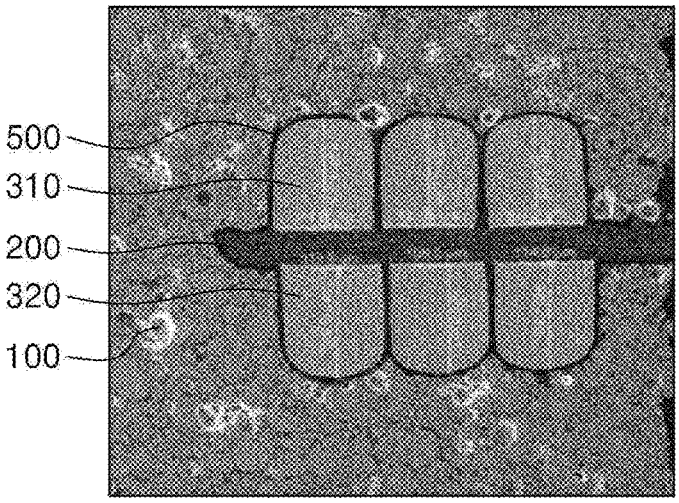

The insulation layer 500 may be disposed between the coil patterns 310 and 320 and the body 100 to insulate the coil patterns 310 and 320 from the metal powder 110. That is, the insulation layer 500 may cover the top and side surfaces of each of the coil patterns 310 and 320. Here, the insulation layer 500 may be formed on the top and side surfaces of each of the coil patterns 310 and 320 at substantially the same thickness. For example, the insulation layer 500 may have a thickness ratio of approximately 1 to 1.2:1 at the top and side surfaces of each of the coil patterns 310 and 320. That is, each of the coil patterns 310 and 320 may have the top surface having a thickness greater by 20% than that of the side surface. Preferably, the top and side surfaces may have the same thickness. Also, the insulation layer 500 may cover the base 200 as well as the top and side surfaces of each of the coil patterns 310 and 320. That is, the insulation layer 500 may be formed on an area exposed by the coil patterns 310 and 320 of the base 200 of which a predetermined region is removed, i.e., a surface and side surface of the base 200. The insulation layer 500 on the base 200 may have the same thickness as the insulation layer 500 on the coil patterns 310 and 320. That is, the insulation layer 500 on the top surface of the base 200 may have the same thickness as the insulation layer 500 on the top surface of each of the coil patterns 310 and 320, and the insulation layer 500 on the side surface of the base 200 may have the same thickness as the insulation layer 500 on the side surface of each of the coil patterns 310 and 320. The parylene may be used so that the insulation layer 500 has substantially the same thickness on the coil patterns 310 and 320 and the base 200. For example, the base 200 on which the coil patterns 310 and 320 are formed may be provided in a deposition chamber, and then, the parylene may be evaporated and supplied into the vacuum chamber to deposit the parylene on the coil patterns 310 and 320. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Alternatively, the insulation layer 500 may be formed of an insulation polymer in addition to the parylene, for example, at least one material selected from epoxy, polyimide, and liquid crystal crystalline polymer. However, the parylene may be applied to form the insulation layer 500 having the uniform thickness on the coil patterns 310 and 320. Also, although the insulation layer 500 has a thin thickness, the insulation property may be improved when compared to other materials. That is, when the insulation layer 500 is coated with the parylene, the insulation layer 500 may have a relatively thin thickness and improved insulation property by increasing a breakdown voltage when compared to a case in which the insulation layer 500 is made of the polyimide. Also, the parylene may be filled between the coil patterns 310 and 320 at the uniform thickness along a gap between the patterns or formed at the uniform thickness along a stepped portion of the patterns. That is, when a distance between the patterns of the coil patterns 310 and 320 is far, the parylene may be applied at the uniform thickness along the stepped portion of the pattern. On the other hand, the distance between the patterns is near, the gap between the patterns may be filled to form the parylene at a predetermined thickness on the coil patterns 310 and 320. FIG. 12 is a cross-sectional photograph of the power inductor in which the insulation layer is made of polyimide, and FIG. 13 is a cross-sectional photograph of the power inductor in which the insulation layer is made of parylene. As illustrated in FIG. 13, in case of the parylene, although the parylene has a relatively thin thickness along the stepped portions of the base 200 and the coil patterns 310 and 320, the polyimide may have a thickness greater than that of the parylene as illustrated in FIG. 12. The insulation layer 500 may have a thickness of 3 μm to 100 μm by using the parylene. When the parylene is formed at a thickness of 3 μm or less, the insulation property may be deteriorated. When the parylene is formed at a thickness exceeding 100 μm, the thickness occupied by the insulation layer 500 within the same size may increase to reduce a volume of the body 100, and thus, the magnetic permeability may be deteriorated. Alternatively, the insulation layer 500 may be manufactured in the form of a sheet having a predetermined thickness and then formed on the coil patterns 310 and 320.

6. Surface Modification Member

A surface modification member (not shown) may be formed on at least one surface of the body 100. The surface modification member may be formed by dispersing oxide onto the surface of the body 100 before the external electrode 400 is formed. Here, the oxide may be dispersed and distributed onto the surface of the body 100 in a crystalline state or an amorphous state. The surface modification member may be distributed on the surface of the body 100 before the plating process when the external electrode 400 is formed through the plating process. That is, the surface modification member may be distributed before the printing process is performed on a portion of the external electrode 400 or be distributed before the plating process is performed after the printing process is performed. Alternatively, when the printing process is not performed, the plating process may be performed after the surface modification member is distributed. Here, at least a portion of the surface modification member distributed on the surface may be melted.

At least a portion of the surface modification member may be uniformly distributed on the surface of the body with the same size, and at least a portion may be non-uniformly distributed with sizes different from each other. Also, a recess part may be formed in a surface of at least a portion of the body 100. That is, the surface modification member may be formed to form a convex part. Also, at least a portion of an area on which the surface modification member is not formed may be recessed to form the concave part. Here, at least a portion of the surface modification member may be recessed from the surface of the body 100. That is, a portion of the surface modification member, which has a predetermined thickness, may be inserted into the body 100 by a predetermined depth, and the rest portion of the surface modification member may protrude from the surface of the body 100. Here, the portion of the surface modification member, which is inserted into the body 100 by the predetermined depth, may have a diameter corresponding to 1/20 to 1 of a mean diameter of oxide particles. That is, all the oxide particles may be impregnated into the body 100, or at least a portion of the oxide particles may be impregnated. Alternatively, the oxide particles may be formed on only the surface of the body 100. Thus, each of the oxide particles may be formed in a hemispherical shape on the surface of the body 100 and in a globular shape. Also, as described above, the surface modification member may be partially distributed on the surface of the body or distributed in a film shape on at least one area of the body 100. That is, the oxide particles may be distributed in the form of an island on the surface of the body 100 to form the surface modification member. That is, the oxide particles having the crystalline state or the amorphous state may be spaced apart from each other on the surface of the body 100 and distributed in the form of the island. Thus, at least a portion of the surface of the body 100 may be exposed. Also, at least two oxide particles may be connected to each other to form the film on at least one area of the surface of the body 100 and the island shape on at least a portion of the surface of the body 100. That is, at least two oxide particles may be aggregated, or the oxide particles adjacent to each other may be connected to each other to form the film. However, although the oxide exists in the particle state, or at least two particles are aggregated with or connected to each other, at least a portion of the surface of the body 100 may be exposed to the outside by the surface modification member.

Here, the total area of the surface modification member may correspond to 5% to 90% of the entire area of the surface of the body 100. Although a plating blurring phenomenon on the surface of the body 100 is controlled in accordance with the surface area of the surface modification member, if the surface modification member is widely formed, the contact between the conductive pattern and the external electrode 400 may be difficult. That is, when the surface modification member is formed on an area of 5% or less of the surface area of the body 100, it may be difficult to control the plating blurring phenomenon. When the surface modification member is formed on an area exceeding 90%, the conductive pattern may not come into contact with the external electrode 400. Thus, it is preferable that a sufficient area on which the plating blurring phenomenon of the surface modification member is controlled, and the conductive pattern contacts the external electrode 400 is formed. For this, the surface modification member may be formed with a surface area of 10% to 90%, preferably, 30% to 70%, more preferably, 40% to 50%. Here, the surface area of the body 100 may be a surface area of one surface thereof or a surface area of six surfaces of the body 100, which define a hexahedral shape. The surface modification member may have a thickness of 10% or less of the thickness of the body 100. That is, the surface modification member may have a thickness of 0.01% to 10% of the thickness of the body 100. For example, the surface modification member may have a size of 0.1 μm to 50 μm. Thus, the surface modification member may have a thickness of 0.1 μm to 50 μm from the surface of the body 100. That is, the surface modification member may have a thickness of 0.1% to 50% of the thickness of the body 100 except for the portion inserted from the surface of the body 100. Thus, the surface modification member may have a thickness greater than that of 0.1 μm to 50 μm when the thickness of the portion inserted into the body 100 is added. That is, when the surface modification member has a thickness of 0.01% or less of the thickness of the body 100, it may be difficult to control the plating blurring phenomenon. When the surface modification member has a thickness exceeding 10%, the conductive pattern within the body 100 may not contact the external electrode 400. That is, the surface modification member may have various thicknesses in accordance with material properties (conductivity, semiconductor properties, insulation, magnetic materials, and the like) of the body 100. Also, the surface modification member may have various thicknesses in accordance with sizes, distributed amount, whether the aggregation occurs, and the like) of the oxide powder.

Since the surface modification member is formed on the surface of the body 100, two areas, which are mode of components different from each other, of the surface of the body 100 may be provided. That is, components different from each other may be detected from the area on which the surface modification member is formed and the area on which the surface modification member is not formed. For example, a component due to the surface modification member, i.e., oxide may exist on the area on which the surface modification member is formed, and a component due to the body 100, i.e., a component of the sheet may exist on the area on which the surface modification member is not formed. Since the surface modification member is distributed on the surface of the body before the plating process, roughness may be given to the surface of the body 100 to modify the surface of the body 100. Thus, the plating process may be uniformly performed, and thus, the shape of the external electrode 400 may be controlled. That is, resistance on at least an area of the surface of the body 100 may be different from that on the other area of the surface of the body 100. When the plating process is performed in a state in which the resistance is non-uniform, ununiformity in growth of the plated layer may occur. To solve this limitation, the oxide that is in a particle state or melted state may be dispersed on the surface of the body 100 to form the surface modification member, thereby modifying the surface of the body 100 and controlling the growth of the plated layer.

Here, at least one oxide may be used as the oxide, which is in the particle or melted state, for realizing the uniform surface resistance of the body 100. For example, at least one of $Bi_2O_3$, $BO_2$, $B_2O_3$, ZnO, $Co_3O_4$, $SiO_2$, $Al_2O_3$, MnO, $H_2BO_3$, $Ca(CO_3)_2$, $Ca(NO_3)_2$, and $CaCO_3$ may be used as the oxide. The surface modification member may be formed on at least one sheet within the body 100. That is, the conductive pattern having various shapes on the sheet may be formed through the plating process. Here, the surface modification member may be formed to control the shape of the conductive pattern.

As described above, in the power inductor in accordance with an exemplary embodiment, the metal powder 110 may be adjusted in size to adjust the magnetic permeability. That is, when the body 100 is made of at least three metal powder 110 having mean grain sizes different from each other, a mixing amount of the metal powder having a large mean grain size may be adjusted to increase the magnetic permeability of the body 100. Therefore, the powder inductor may be improved in inductance. Also, since the body 100 including the thermal conductive filler in addition to the metal powder 110 and the polymer 120 is manufactured, the heat of the body 100 due to the heating of the metal powder 110 may be released to the outside to prevent the body from increasing in temperature and also from the inductance from being reduced. Also, since the insulation layer 500 is formed between the coil patterns 310 and 320 and the body 100 by using the parylene, the insulation layer 500 may be formed with a thin thickness on the side surface and the top surface of each of the coil patterns 310 and 320 to improve the insulation property. Also, since the base 200 within the body 100 is made of the metal magnetic material, the decreases of the magnetic permeability of the power inductor may be prevented. Also, at least a portion of the base 200 may be removed, and the body 100 may be filled into the removed portion to improve the magnetic permeability.

Experimental Example

Following tests were performed for explaining a variation in magnetic permeability depending on the metal powder in accordance with an exemplary embodiment. First, metal powder having various sizes were prepared for tests in accordance with an exemplary embodiment. That is, first metal powder having various size were prepared, and second and third metal powder were prepared. The first metal powder having mean grain-size distribution of 55 μm, 40 μm, 31 μm, and 23 μm with respect to D50 were prepared. Here, the first metal powder having the grain-size distribution of 40 μm and 55 μm were sieved and thus had mean grain-size distribution of 40 μm and 55 μm or more. The second and third metal powder having the mean grain-size distribution of 3 μm and 1.5 μm with respect to D50 were prepared. Here, the first and second metal powder having compositions of Fe, Si, and Cr, which are different from each other, were prepared, and the third metal powder having a composition of Fe, C, O, P, and the like was prepared.

The metal powder having the various sizes were mixed with a binder to manufacture various slurry. Here, the slurry was manufactured by mixing 97.5 wt % of the metal powder with 2.5 wt % of the binder with respect to 100 wt % of the slurry. Here, the metal powder and the binder were adjusted in content to measure characteristics depending on the content of the binder. The slurry was molded to a thickness of 70 μm±3 μm and cut to a size of 150 mm to 150 mm to manufacture a sheet. Also, 5 sheets were laminated and compressed for 30 seconds at a pressure of 120 kg f to mold a body, and then, a thermosetting process was performed for 1 hour at a temperature of 200° C.

Variation in Magnetic Permeability and Q Factor According to Heat Treatment

Figure 14:
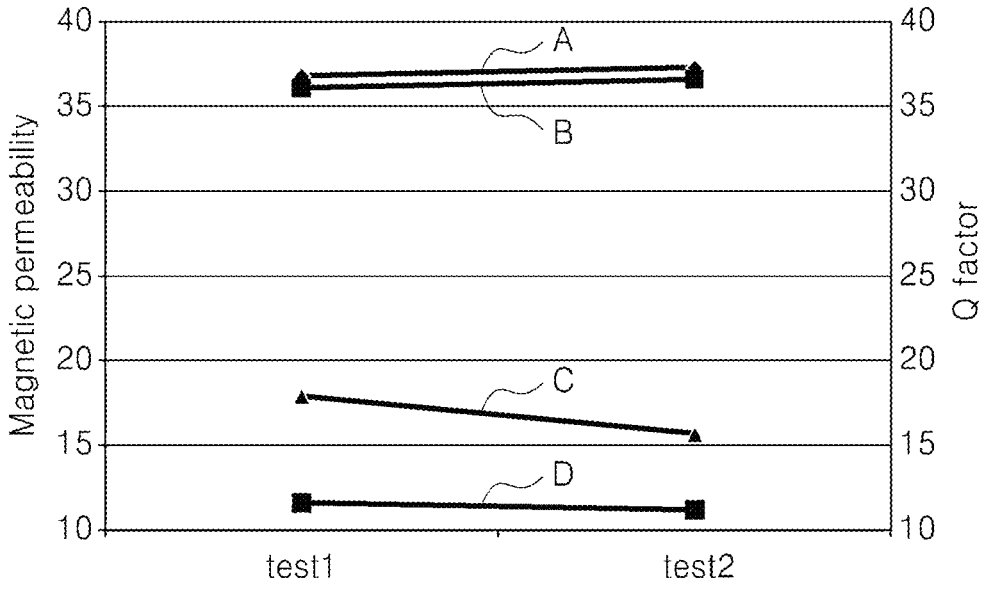
FIGS. 14 to 21 are views of magnetic permeability and Q factors depending on experimental examples in accordance with an exemplary embodiment.

The first, second, and third metal powder were mixed with each other to manufacture metal powder. Here, the first metal powder has mean grain-size distribution of 31 μm, and the second and third metal powder respectively have mean grain-size distribution of 3 μm and 1.5 μm. The first, second, and third metal powder were mixed at a ratio of 7:1:2. That is, 70 wt % of the first metal powder, 10 wt % of the second metal powder, and 20 wt % of the third metal powder with respect to 100 wt % of the total metal powder were mixed with each other. Then, magnetic permeability and quality factors (hereinafter, referred to as a Q factor) at 3 MHz and 5 MHz when the heat treatment is performed (test 1) and is not performed (test 2) were shown in Table 1 and illustrated in FIG. 14. The heat treatment was performed for 1 hour at a temperature of 300° C. In FIG. 14, A and B represent magnetic permeability at 3 MHz and 5 MHz according to the heat treatment, and C and D represent Q factors at 3 MHz and 5 MHz according to the heat treatment.

TABLE 1

| | Magnetic Permeability | | Q factor | |
|---|---|---|---|---|
| | 3 MHz | 5 MHz | 3 MHz | 5 MHz |
| test 1 | 36.8 | 36.1 | 17.9 | 11.6 |
| test 2 | 37.7 | 36.6 | 15.7 | 11.2 |

As shown in Table 1 and illustrated in FIG. 14, in case of a heat treatment test 2, the magnetic permeability increased by approximately 0.5 to approximately 1, and the Q factor decreased by approximately 0.4 to approximately 1.8 when compared to the test 1 in which the heat treatment is not performed. Thus, the magnetic permeability may be improved through the heat treatment of the metal powder.

Magnetic Permeability and Q Factor According to Size of First Metal Powder

Figure 15:
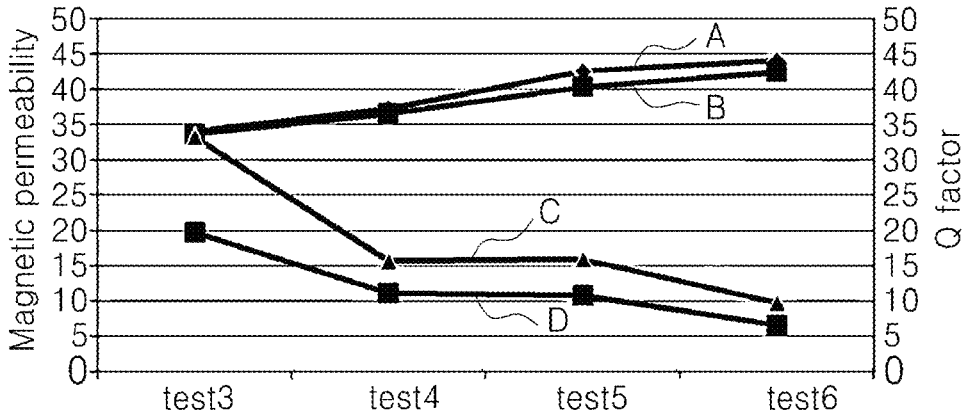

The first metal powder varied in size to measure magnetic permeability and a Q factor. The first metal powder varied in size to 23 μm, 31 μm, 40 μm, and 55 μm (test 3 to test 6), and the second and third metal powder was respectively maintained to sizes of 3 μm and 1.5 μm. Here, the first metal powder having the sizes of 23 μm and 31 μm were not sieved, and the first metal powder having the sizes of 40 μm and 55 μm were sieved. Also, the first, second, and third metal powder were mixed at a ratio of 7:1:2. That is, 70 wt % of the first metal powder, 10 wt % of the second metal powder, and 20 wt % of the third metal powder with respect to 100 wt % of the total metal powder were mixed with each other. Then, the mixed metal powder was thermally treated for 1 hour at a temperature of 300° C. The magnetic permeability and the Q factor according to the variation in size of the first metal powder were shown in Table 2 and illustrated in FIG. 15. In FIG. 15, A and B represent magnetic permeability at 3 MHz and 5 MHz according to the size of the first metal powder, and C and D represent Q factors at 3 MHz and 5 MHz according to the size of the first metal powder.

TABLE 2

| | Magnetic Permeability | | Q factor | |
|---|---|---|---|---|
| | 3 MHz | 5 MHz | 3 MHz | 5 MHz |
| test 3 | 34 | 33.7 | 33.3 | 19.8 |
| test 4 | 37.3 | 36.6 | 15.7 | 11.2 |
| test 5 | 42.6 | 40.4 | 15.97 | 10.8 |
| test 7 | 44.1 | 42.5 | 9.8 | 6.6 |

As shown in Table 2 and illustrated in FIG. 15, as the first metal powder, i.e., the main metal powder increases in size, the magnetic permeability increases, and the Q factor decreases. Therefore, the main metal powder may be controlled in size to adjust the magnetic permeability.

Magnetic Permeability and Q Factor According to Mixing of First Metal Powder

Figure 16:
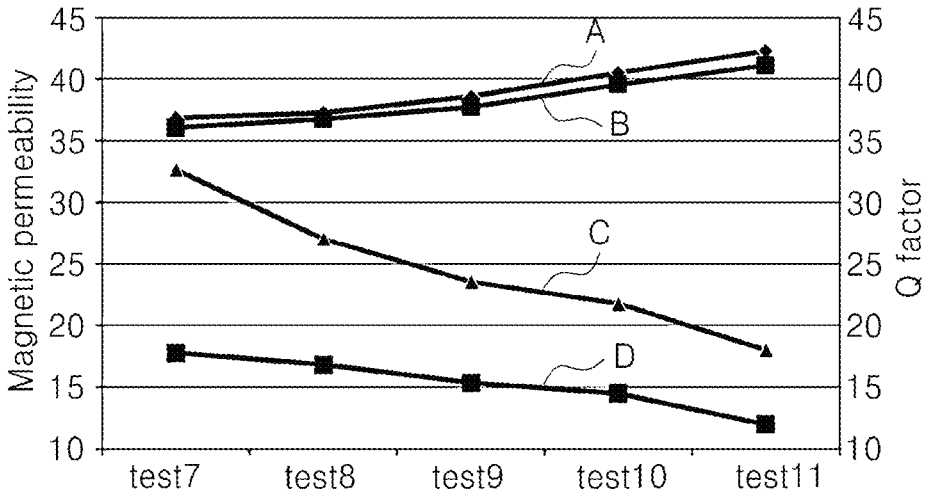

First-1 and first-2 metal powder having different sizes were mixed with each other to measure magnetic permeability and a Q factor. The first-1 metal powder had a size of 31 μm, and the first-2 metal powder has a size of 23 μm. Also, the second and third metal powder were maintained to sizes of 3 μm and 1.5 μm, respectively. Also, a mixing ratio of the first-1 and first-2 metal powder was adjusted to 0:8 to 8:0 (test 7 to test 11), and the second and third metal powder were mixed at a ratio of 1.5:0.5. Also, heat treatment was performed for 1 hour at a temperature of 300° C. That is, the first-1 and first-2 metal powder had a ratio of 0:8, 1:7, 3:4, 4:4, and 8:0, and the second and third metal powder had a ratio of 1.5:0.5. The magnetic permeability and the Q factor according to the mixing ratio of the two first metal powder having different sizes were shown in Table 3 and illustrated in FIG. 16. In FIG. 16, A and B represent magnetic permeability at 3 MHz and 5 MHz according to the maxing ratio of the first metal powder, and C and D represent Q factors at 3 MHz and 5 MHz according to the mixing ratio of the first metal powder.

TABLE 3

| Mixing ratio of first-1 and first-2 | Magnetic Permeability | | Q factor | |
|---|---|---|---|---|
| metal powder | 3 MHz | 5 MHz | 3 MHz | 5 MHz |
| test 7(0:8) | 36.9 | 36.1 | 32.7 | 17.8 |
| test 8(1:7) | 37.31 | 36.77 | 27.09 | 16.84 |
| test 9(3:4) | 38.63 | 37.78 | 23.59 | 15.4 |
| test 10(4:4) | 40.57 | 39.62 | 21.8 | 14.5 |
| test 11(8:0) | 42.33 | 41.15 | 18.05 | 12.01 |

As shown in Table 3 and illustrated in FIG. 16, as the fineness particles having large mean grain-size distribution increase in content, the magnetic permeability increases, and the Q factor decreases.

Magnetic Permeability and Q Factor According to Sieving of First Metal Powder

Figure 17:
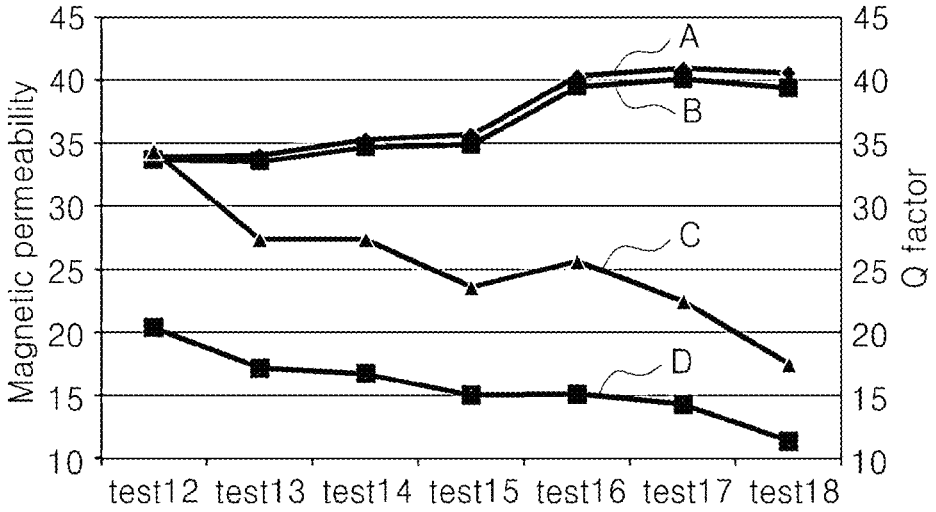

A portion of the first metal powder is sieved to measure magnetic permeability and a Q factor. That is, the first-1 metal powder was sieved to provide mean grain-size distribution of 40 μm or more, and the first-2 metal powder did not sieved to provide mean grain-size distribution of 23 μm. Also, the second and third metal powder were maintained to sizes of 3 μm and 1.5 μm, respectively. Also, a mixing ratio of the first-1 and first-2 metal powder was adjusted to 0:7 to 6:1 (test 12 to test 18), and the second and third metal powder were mixed at a ratio of 2:1. That is, the first metal powder including the first-1 and first-2 metal powder and the second and third metal powder were mixed at a ratio of 7:2:1. Also, heat treatment was performed for 1 hour at a temperature of 300° C. The magnetic permeability and the Q factor according to the mixing ratio of the sieved first-1 metal powder were shown in Table 4 and illustrated in FIG. 17. In FIG. 17, A and B represent magnetic permeability at 3 Mhz and 5 Mhz, and C and D represent Q factors at 3 MHz and 5 MHz.

TABLE 4

| Mixing ratio of first-1 and first-2 metal powder | Magnetic Permeability 3 MHz | Magnetic Permeability 5 MHz | Q factor 3 MHz | Q factor 5 MHz |
|---|---|---|---|---|
| test 12(0:7) | 33.9 | 33.7 | 34.4 | 20.4 |
| test 13(1:6) | 34.03 | 33.6 | 27.4 | 17.19 |
| test 14(2:5) | 35.3 | 34.74 | 27.39 | 16.73 |
| test 15(3:4) | 35.7 | 34.91 | 23.62 | 15.05 |
| test 16(4:3) | 40.35 | 39.52 | 25.68 | 15.11 |
| test 17(5:2) | 40.95 | 40.12 | 22.52 | 14.31 |
| test 18(6:1) | 40.6 | 39.4 | 17.51 | 11.4 |

As shown in Table 4 and illustrated in FIG. 17, as the fineness particles having a large grain size after sieving increase in content, the magnetic permeability increases, and the Q factor decreases.

Figure 18:
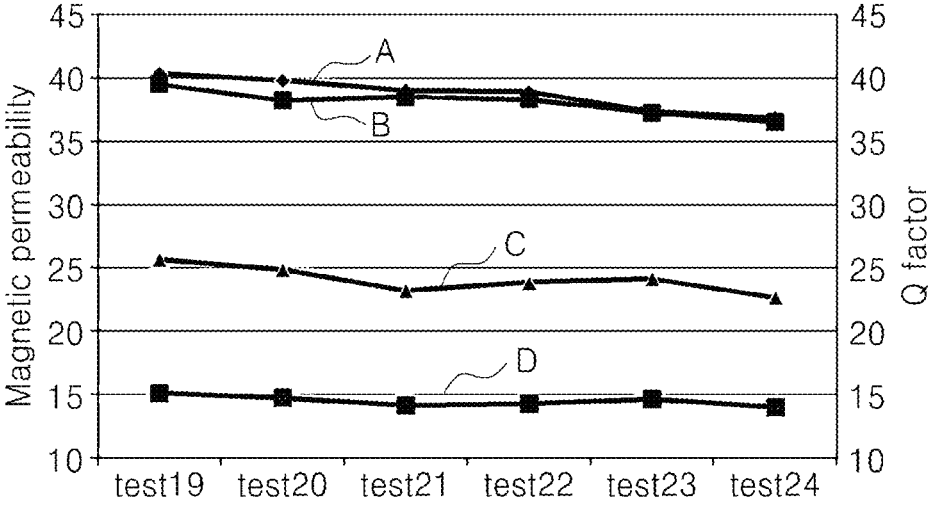

Variation in Magnetic Permeability and Q Factor According to Adding of Remaining Powder after Sieving When the powder remaining after sieving a portion of the first metal powder is added, magnetic permeability and a Q factor were measured. That is, the first-1 metal powder was sieved to provide mean grain-size distribution of 40 μm or more, and the first-2 metal powder was provided by mixing the sieved powder with the powder that is not sieved. Here, the first-2 metal powder includes first-2-1 metal powder that is not sieved and has mean grain-size distribution of 23 μm and first-2-2 metal powder that remains after the sieving and has mean grain-size distribution of 23 μm. Here, the first-2-1 metal powder and the first-2-2 metal powder were adjusted to a ratio of 2:0 to 0.5:1.5 (test 19 to test 24), and the first-1 metal powder and the second and third metal powder were supplied to a ratio of 5:2:1. That is, the first-1 metal powder, the first-2-1 and first-2-2 metal powder, and the second and third metal powder have a ratio of 5:2 to 0.5:0 to 1.5:2:1. Also, heat treatment was performed for 1 hour at a temperature of 300° C. The magnetic permeability and the Q factor when a portion of the metal powder that is not sieved is substituted by the metal powder remaining after the sieving were shown in Table 5 and illustrated in FIG. 18. In FIG. 18, A and B represent magnetic permeability at 3 MHz and 5 MHz, and C and D represent Q factors at 3 MHz and 5 MHz.

TABLE 5

| Mixing ratio of first-2-1 and first-2-2 metal powder | Magnetic Permeability 3 MHz | Magnetic Permeability 5 MHz | Q factor 3 MHz | Q factor 5 MHz |
|---|---|---|---|---|
| test 19(2:0) | 40.35 | 39.52 | 25.68 | 15.11 |
| test 20(1.75:0.25) | 39.82 | 38.25 | 24.86 | 14.73 |
| test 21(1.5:0.5) | 39.03 | 38.51 | 23/22 | 14.13 |
| test 22(1.25:0.75) | 38.9 | 38.3 | 23.87 | 14.29 |
| test 23(1:1) | 37.39 | 37.25 | 24.16 | 14.64 |
| test 24(0.5:1.5) | 36.88 | 36.55 | 22.67 | 13.99 |

As described above, it is seen that the magnetic permeability and the Q factor are reduced when the powder remaining after the sieving is substituted for a portion of the composition. Thus, the powder remaining after the sieving has no improvement.

Figure 19:
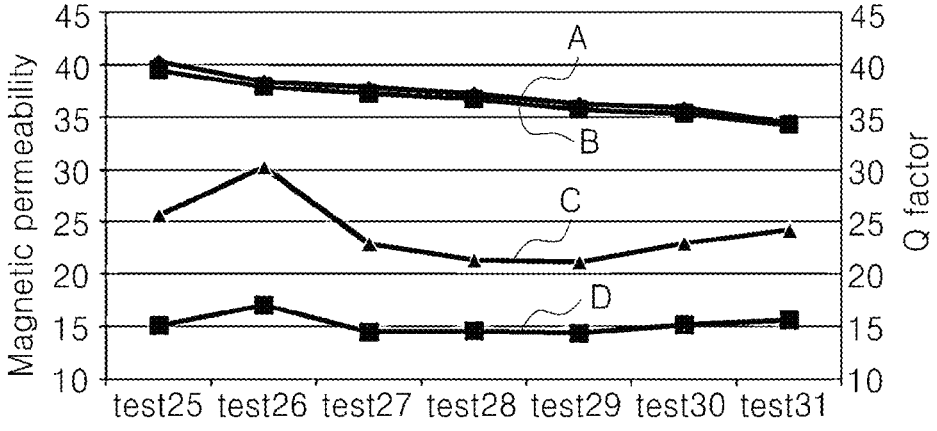

Magnetic Permeability and Q Factor According to Decrease in Size of First Metal Powder The magnetic permeability and the Q factor when the first metal powder is reduced in size were measured. That is, the first-1 metal powder was sieved to provide mean grain-size distribution of 40 μm or more, and the first-2 metal powder was provided by mixing different metal powder that is not sieved. Here, the first-2 metal powder includes first-2-1 metal powder that is not sieved and has mean grain-size distribution of 23 μm and first-2-2 metal powder that is not sieved and has mean grain-size distribution of 8 μm. Here, the first-2-1 metal powder and the first-2-2 metal powder were adjusted to a ratio of 2:0 to 0.5:1.5 (test 25 to test 31), and the first-1 metal powder and the second and third metal powder were supplied to a ratio of 5:2:1. That is, the first-1 metal powder, the first-2-1 and first-2-2 metal powder, and the second and third metal powder have a ratio of 5:2 to 0.5:0 to 1.5:2:1. Also, heat treatment was performed for 1 hour at a temperature of 300° C. The magnetic permeability and the Q factor when the first metal powder is reduced in size were shown in Table 6 and illustrated in FIG. 19. In FIG. 19, A and B represent magnetic permeability at 3 Mhz and 5 Mhz, and C and D represent Q factors at 3 MHz and 5 MHz.

TABLE 6

| Mixing ratio of first-2-1 and first-2-2 metal powder | Magnetic Permeability 3 MHz | Magnetic Permeability 5 MHz | Q factor 3 MHz | Q factor 5 MHz |
|---|---|---|---|---|
| test 25(2:0) | 40.35 | 39.52 | 25.68 | 15.11 |
| test 26(1.95:0.55) | 38.46 | 37.94 | 30.32 | 17.07 |
| test 27(1.9:0.1) | 37.86 | 37.29 | 22.94 | 14.51 |
| test 28(1.8:0.2) | 37.27 | 36.73 | 21.39 | 14.58 |
| test 29(1.7:0.3) | 36.32 | 35.76 | 21.2 | 14.38 |
| test 30(1.6:0.4) | 35.89 | 35.37 | 22.99 | 15.17 |
| test 31(1.5:0.5) | 34.53 | 34.3 | 24.26 | 15.65 |

As described above, as the metal powder is substituted by the metal powder having a small grain size, the magnetic permeability may decrease, and the Q factor may be partially improved. Particularly, in case in which a small amount of metal powder is substituted, the Q factor may be improved.

Magnetic Permeability and Q Factor According to Content of Third Metal Powder

Figure 20:
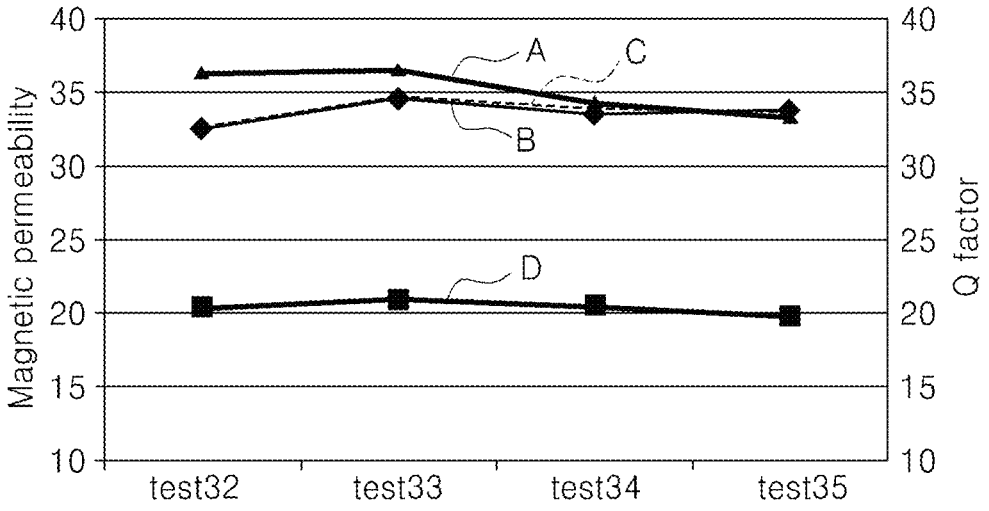

The magnetic permeability and the Q factor according to a content of the third metal powder were measured. That is, the first metal powder has mean grain-size distribution of 23 μm without being sieved, and the second and third metal powder respectively have mean grain-size distribution of 3 μm and 1.5 μm. Here, the first metal powder was fixed in content, and the second and third metal powder were adjusted in content. That is, the contents of the second and third metal powder were adjusted at a ratio of 3:0 to 1:2 (test 32 to test 35). Thus, the first metal powder and the second and third metal powder are mixed with at a ratio of 7:3 to 1:0 to 2. Also, heat treatment was performed for 1 hour at a temperature of 300° C. The magnetic permeability and the Q factor when the second and third metal powder vary in content were shown in Table 7 and illustrated in FIG. 20. In FIG. 20, A and B represent magnetic permeability at 3 MHz and 5 MHz, and C and D represent Q factors at 3 MHz and 5 MHz.

TABLE 7

| Mixing ratio of second and third metal powder | Magnetic Permeability | | Q factor | |
|---|---|---|---|---|
| | 3 MHz | 5 MHz | 3 MHz | 5 MHz |
| test 32(3:0) | 32.8 | 32.7 | 36.4 | 20.4 |
| test 33(2.5:1.5) | 34.6 | 34.5 | 36.6 | 20.9 |
| test 34(2:1) | 33.9 | 33.7 | 34.4 | 20.4 |
| test 35(1:2) | 34 | 33.7 | 33.3 | 19.8 |

As described above, when a portion of amorphous fineness particles is substituted by a small amount of CIP, the magnetic permeability and the Q factor may be improved.

Magnetic Permeability and Q Factor According to Content of Binder

Figure 21:
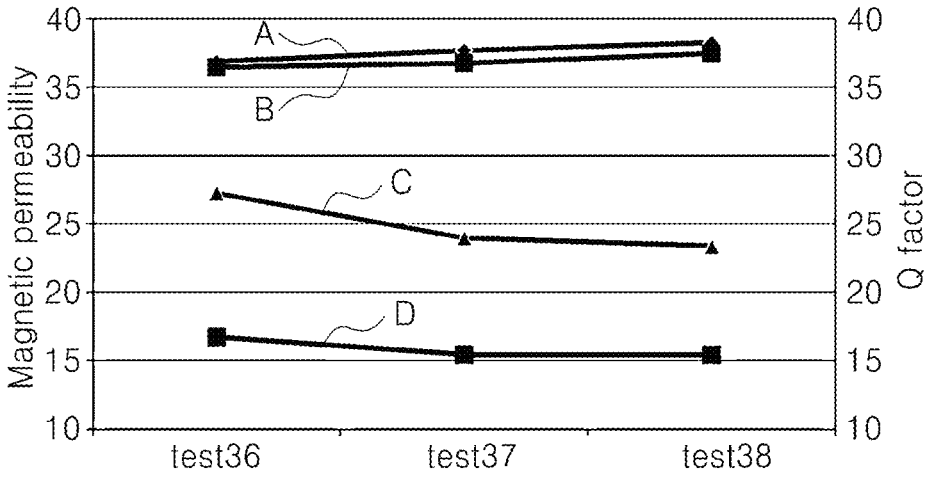

Magnetic permeability and Q factor according to content of binder That is, the first-1 metal powder was sieved to provide mean grain-size distribution of 40 μm or more, and the first-2 metal powder did not sieved to provide mean grain-size distribution of 23 μm. Also, the second and third metal powder were maintained to sizes of 3 μm and 1.5 μm, respectively. Here, the first-1 and first-2 metal powder and the second and third metal powder were mixed at a ratio of 3:4:2.5:0.5. The metal powder was thermally treated for 1 hour at a temperature of 300° C. Also, the metal powder was mixed with a binder having various contents to measure the magnetic permeability and the Q factor. That is, the magnetic permeability and the Q factor when the binder has contents of 2.5 wt %, 2.25 wt %, and 2.0 wt % (test 36 to test 38) were measured. Thus, in the tests 36 to 38, the metal powder varied in content to 97.5 wt %, 97.75 wt %, and 98 wt %. That is, when a mixture of the metal powder and the binder has a content of 100 wt %, the metal powder and the binder were adjusted in content. The magnetic permeability and the Q factor according to the contents of the binder were shown in Table 8 and illustrated in FIG. 21. In FIG. 21, A and B represent magnetic permeability at 3 MHz and 5 MHz, and C and D represent Q factors at 3 MHz and 5 MHz.

TABLE 8

| Variation in content of binder | Magnetic Permeability | | Q factor | |
|---|---|---|---|---|
| | 3 MHz | 5 MHz | 3 MHz | 5 MHz |
| test 36(2.5 wt %) | 36.88 | 36.46 | 27.29 | 16.74 |
| test 37(2.25 wt %) | 37.7 | 36.77 | 24.01 | 15.46 |
| test 38(2.0 wt %) | 38.27 | 37.47 | 23.4 | 15.45 |

As described above, as the binder decreases in content, the magnetic permeability increases, and the Q factor decreases.

EMBODIMENTS AND MODIFIED EXAMPLE

A power inductor in accordance with various embodiments and modified examples will be described.

Figure 22:
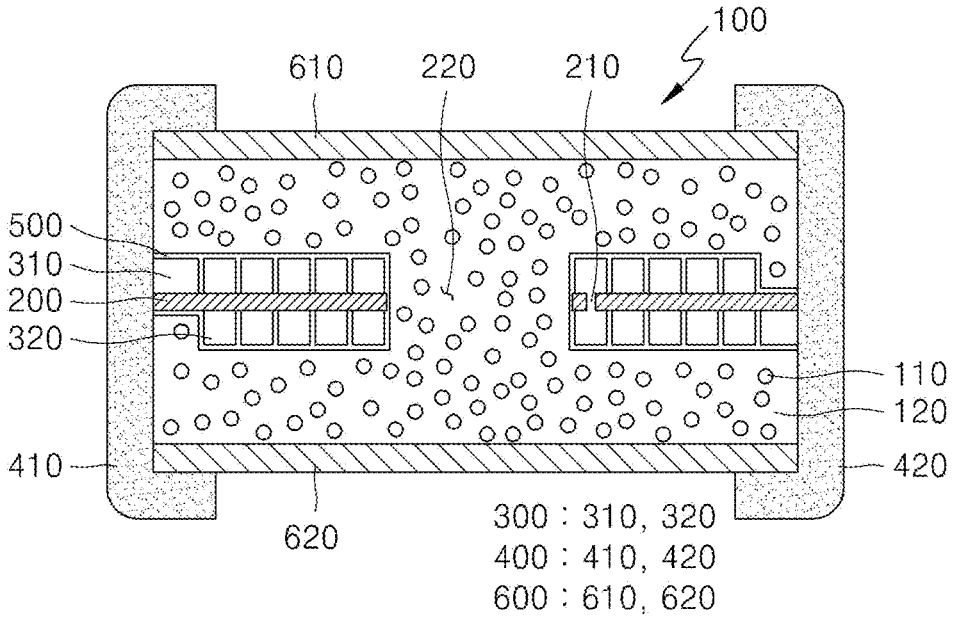
FIGS. 22 and 23 are cross-sectional views of a power inductor in accordance with another exemplary embodiment.

FIG. 22 is a cross-sectional view of a power inductor in accordance with another exemplary embodiment.

Referring to FIG. 22, a power inductor in accordance with another exemplary embodiment may include a body 100 including a thermal conductive filler, a base 200 provided in the body 100, coil patterns 310 and 320 disposed on at least one surface of the base 200, external electrodes 410 and 420 provided outside the body 100, an insulation layer 500 provided on each of the coil patterns 310 and 320, and at least one magnetic layer 600 (610 and 620) provided on each of top and bottom surfaces of the body 100. That is, another exemplary embodiment may be realized by further providing the magnetic layer 600 in accordance with the foregoing embodiment. Hereinafter, constitutions different from those in accordance with the foregoing embodiment will be mainly described in accordance with another exemplary embodiment.

The magnetic layer 600 (610, 620) may be disposed on at least one area of the body 100. That is, a first magnetic layer 610 may be disposed on the top surface of the body 100, and the second magnetic layer 620 may be disposed on the bottom surface of the body 100. Here, the first and second magnetic layers 610 and 620 may be provided to improve magnetic permeability of the body 100 and also may be made of a material having magnetic permeability grater than that of the body 100. For example, the body 100 may have magnetic permeability of 20, and each of the first and second magnetic layers 610 and 620 may have magnetic permeability of 40 to 1000. Each of the first and second magnetic layers 610 and 620 may be manufactured by using, for example, magnetic powder and a polymer. That is, each of the first and second magnetic layers 610 and 620 may be made of a material having magnetism greater than that of the magnetic material of the body 100 or having a content of the magnetic material greater than that of the magnetic material of the body so as to have magnetic permeability greater than that of the body 100. Here, the polymer may be added to a content of 15 wt % with respect to 100 wt % of the metal powder. Also, the metal powder may use at least one selected from the group consisting of Ni ferrite, Zn ferrite, Cu ferrite, Mn ferrite, Co ferrite, Ba ferrite and Ni—Zn—Cu ferrite or at least one oxide magnetic material thereof. That is, the magnetic layer 600 may be formed by using metal alloy power including iron or metal alloy oxide containing iron. Also, a magnetic material may be applied to the metal alloy powder to form magnetic powder. For example, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be applied to the metal alloy powder including iron to form the magnetic powder. That is, the metal oxide including iron may be applied to the metal alloy powder to form the magnetic powder. Alternatively, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be mixed with the metal alloy powder including iron to form the magnetic powder. That is, the metal oxide including iron may be mixed with the metal alloy powder to form the magnetic powder. Each of the first and second magnetic layers 610 and 620 may further include a thermal conductive filler in addition to the metal powder and the polymer. The thermal conductive filler may be contained to a content of 0.5 wt % to 3 wt % with respect to 100 wt % of the metal powder. Each of the first and second magnetic layers 610 and 620 may be manufactured in the form of a sheet and disposed on each of the top and bottom surfaces of the body 100 on which the plurality of sheets are laminated. Also, paste made of a material including the metal powder 110, the polymer 120, and the thermal conductive filler may be printed to a predetermined thickness or may be put into a frame and then compressed to form the body 100, thereby forming the first and second magnetic layers 610 and 620 on the top and bottom surfaces of the body 100. Also, each of the first and second magnetic layers 610 and 620 may be formed by using paste. That is, a magnetic material may be applied to the top and bottom surfaces of the body 100 to form the first and second magnetic layer 610 and 620.

Figure 23:
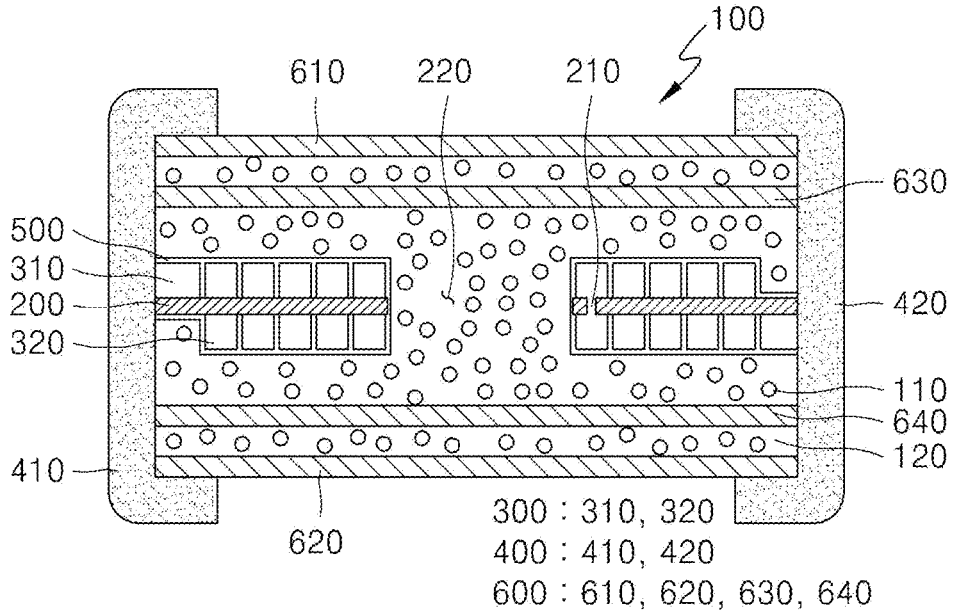

In the power inductor in accordance with another exemplary embodiment, third and fourth magnetic layers 630 and 640 may be further provided between the first and second magnetic layers 610 and 620 and the base 200 as illustrated in FIG. 23. That is, at least one magnetic layer 600 may be provided in the body 100. The magnetic layer 600 may be manufactured in the form of the sheet and disposed in the body 100 on which the plurality of sheets are laminated. That is, at least one magnetic layer 600 may be provided between the plurality of sheets for manufacturing the body 100. Also, when the paste made of the material including the metal powder 110, the polymer 120, and the thermal conductive filler may be printed at a predetermined thickness to form the body 100, the magnetic layer may be formed during the printing. When the paste is put into a frame and then pressed, the magnetic layer may be disposed between the paste and the frame, and then, the pressing may be performed. Of course, the magnetic layer 600 may be formed by using the paste. Here, when the body 100 is formed, a soft magnetic material may be applied to form the magnetic layer 600 within the body 100.

As described above, in the power inductor according to another embodiment of the present inventive concept, the at least one magnetic layer 600 may be provided in the body 100 to improve the magnetic permeability of the power inductor.

Figure 24:
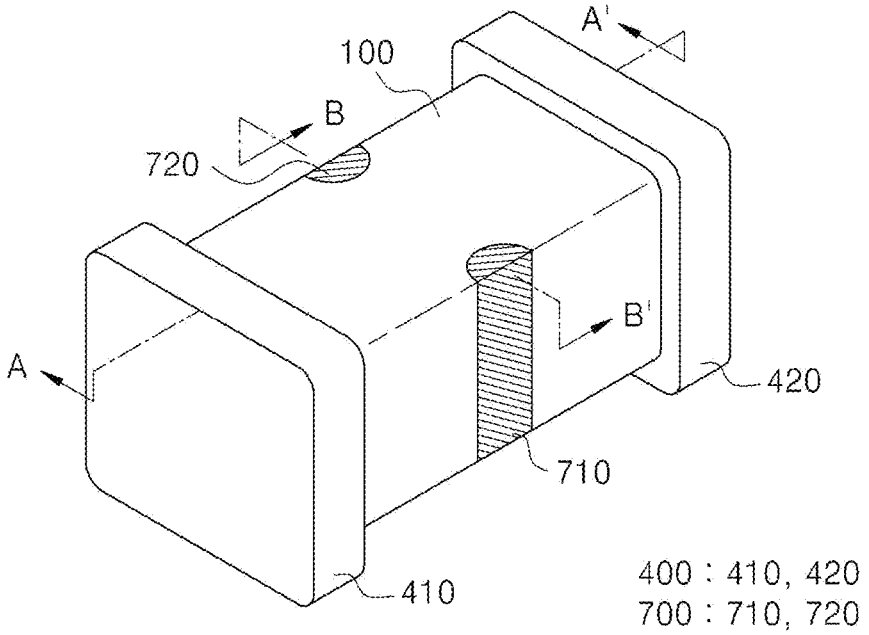
FIG. 24 is a perspective view of a power inductor in accordance with further another exemplary embodiment.
Figure 25:
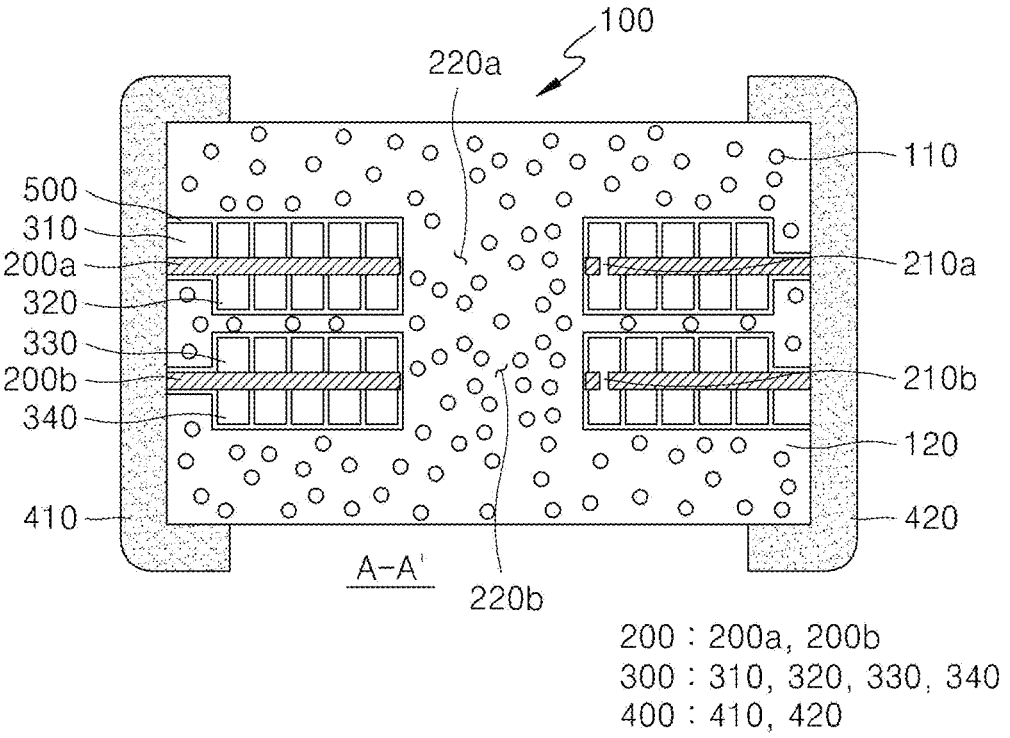
FIGS. 25 and 26 are cross-sectional views taken along lines A-A' and B-B' of FIG. 24, respectively.
Figure 26:
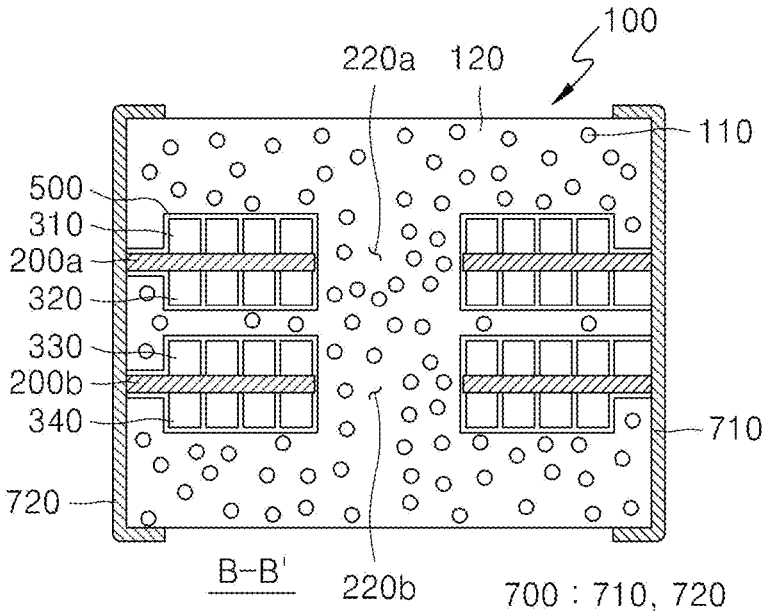

FIG. 24 is a perspective view of a power inductor in accordance with further another exemplary embodiment, FIG. 25 is a cross-sectional view taken along line A-A' of FIG. 24, and FIG. 26 is a cross-sectional view taken along line B-B' of FIG. 24.

Referring to FIGS. 24 to 26, a power inductor in accordance with further another exemplary embodiment may include a body 100, at least two bases 200*a* and 200*b* (200) provided in the body 100, coil patterns 300 (310, 320, 330, and 340) disposed on at least one surface of each of the at least two bases 200, external electrodes 410 and 420 disposed outside the body 100, an insulation layer 500 disposed on the coil patterns 500, and connection electrodes 700 (710 and 720) spaced apart from the external electrodes 410 and 420 outside the body 100 and connected to at least one coil pattern 300 disposed on each of at least two boards 300 within the body 100. Hereinafter, descriptions duplicated with those in accordance with the foregoing embodiments will be omitted.

The at least two bases 200 (200*a* and 200*b*) may be provided in the body 100 and spaced a predetermined distance from each other a short axial direction of the body 100. That is, the at least two bases 200 may be spaced a predetermined distance from each other in a direction perpendicular to the external electrode 400, i.e., in a thickness direction of the body 100. Also, conductive vias 210 (210*a* and 210*b*) may be formed in the at least two bases 200, respectively. Here, at least a portion of each of the at least two bases 200 may be removed to form each of through-holes 220 (220*a* and 220*b*). Here, the through-holes 220*a* and 220*b* may be formed in the same position, and the conductive vias 210*a* and 210*b* may be formed in the same position or positions different from each other. Of course, an area of the at least two bases 200, in which the through-hole 220 and the coil pattern 300 are not provided, may be removed, and then, the body 100 may be filled. The body 100 may be disposed between the at least two bases 200. The body 100 may be disposed between the at least two bases 200 to improve magnetic permeability of the power inductor. Of course, since the insulation layer 500 is disposed on the coil pattern 300 disposed on the at least two bases 200, the body 100 may not be provided between the bases 200. In this case, the power inductor may be reduced in thickness.

The coil patterns 300 (310, 320, 330, and 340) may be disposed on at least one surface of each of the at least two bases 200, preferably, both surfaces of each of the at least two bases 200. Here, the coil patterns 310 and 320 may be disposed on lower and upper portions of a first substrate 200*a* and electrically connected to each other by the conductive via 210*a* provided in the first base 200*a*. Similarly, the coil patterns 330 and 340 may be disposed on lower and upper portions of a second substrate 200*b* and electrically connected to each other by the conductive via 210*b* provided in the second base 200*b*. Each of the plurality of coil patterns 300 may be formed in a spiral shape on a predetermined area of the base 200, e.g., outward from the through-holes 220*a* and 220*b* in a central portion of the base 200. The two coil patterns 310 and 320 disposed on the base 200 may be connected to each other to form one coil. That is, at least two coils may be provided in one body 100. Here, the upper coil patterns 310 and 330 and the lower coil patterns 320 and 340 of the base 200 may have the same shape. Also, the plurality of coil patterns 300 may overlap each other. Alternatively, the lower coil patterns 320 and 340 may be disposed to overlap an area on which the upper coil patterns 310 and 330 are not disposed.

The external electrodes 400 (410 and 420) may be disposed on both ends of the body 100. For example, the external electrodes 400 may be disposed on two side surfaces of the body 100, which face each other in a longitudinal direction. The external electrode 400 may be electrically connected to the coil patterns 300 of the body 100. That is, at least one end of each of the plurality of coil patterns 300 may be exposed to the outside of the body 100, and the external electrode 400 may be connected to the end of each of the plurality of coil patterns 300. For example, the external electrode 410 may be connected to the coil pattern 310, and the external pattern 420 may be connected to the coil pattern 340. That is, the external electrode 400 may be connected to each of the coil patterns 310 and 340 disposed on the bases 200*a* and 200*b*.

The connection electrode 700 may be disposed on at least one side surface of the body 100, on which the external electrode 400 is not provided. For example, the external electrode 400 may be disposed on each of first and second side surfaces facing each other, and the connection electrode 700 may be disposed on each of third and fourth side surfaces on which the external electrode 400 is not provided. The connection electrode 700 may be provided to connect at least one of the coil patterns 310 and 320 disposed on the first base 200*a* to at least one of the coil patterns 330 and 340 disposed on the second base 200*b*. That is, the connection electrode 710 may connect the coil pattern 320 disposed below the first base 200*a* to the coil pattern 330 disposed above the second base 200*b* at the outside of the body 100. That is, the external electrode 410 may be connected to the coil pattern 310, the connection electrode 710 may connect the coil patterns 320 and 330 to each other, and the external electrode 420 may be connected to the coil pattern 340. Thus, the coil patterns 310, 320, 330, and 340 disposed on the first and second bases 200*a* and 200*b* may be connected to each other in series. Although the connection electrode 710 connects the coil patterns 320 and 330 to each other, the connection electrode 720 may not be connected to the coil patterns 300. This is done because, for convenience of processes, two connection electrodes 710 and 720 are provided, and only one connection electrode 710 is connected to the coil patterns 320 and 330. The connection electrode 700 may be formed by immersing the body 100 into conductive paste or formed on one side surface of the body 100 through various methods such as printing, deposition, and sputtering. The connection electrode 700 may include a metal have electrical conductivity, e.g., at least one metal selected from the group consisting of gold, silver, platinum, copper, nickel, palladium, and an alloy thereof. Here, a nickel-plated layer (not show) and a tin-plated layer (not shown) may be further disposed on a surface of the connection electrode 700.

Figure 27:
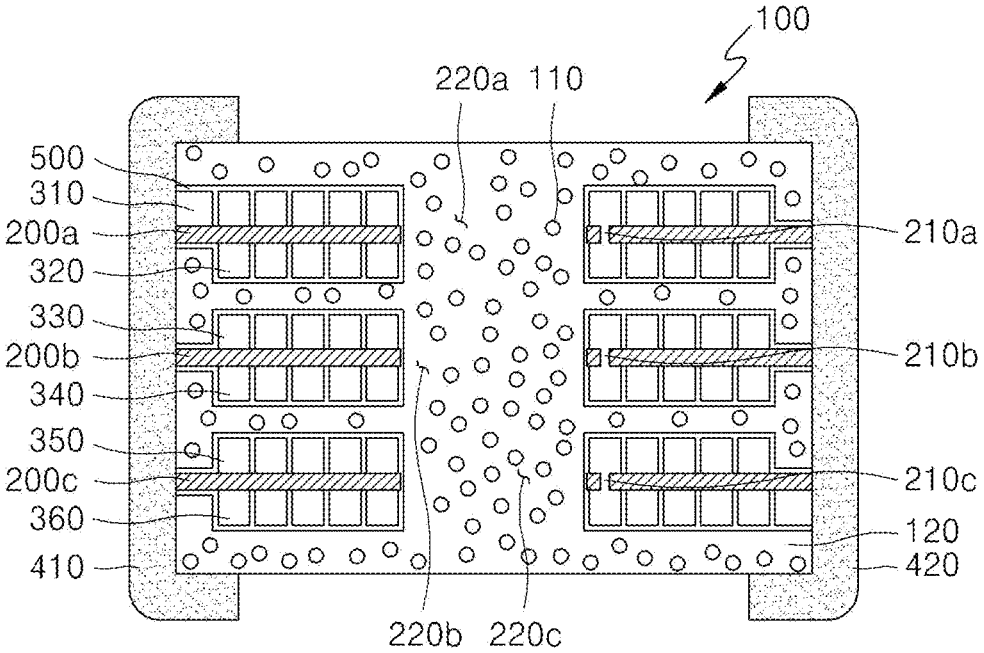
FIGS. 27 and 28 are cross-sectional views taken along lines A-A' and B-B' of FIG. 17 in accordance with modified examples of further another exemplary embodiment.
Figure 28:
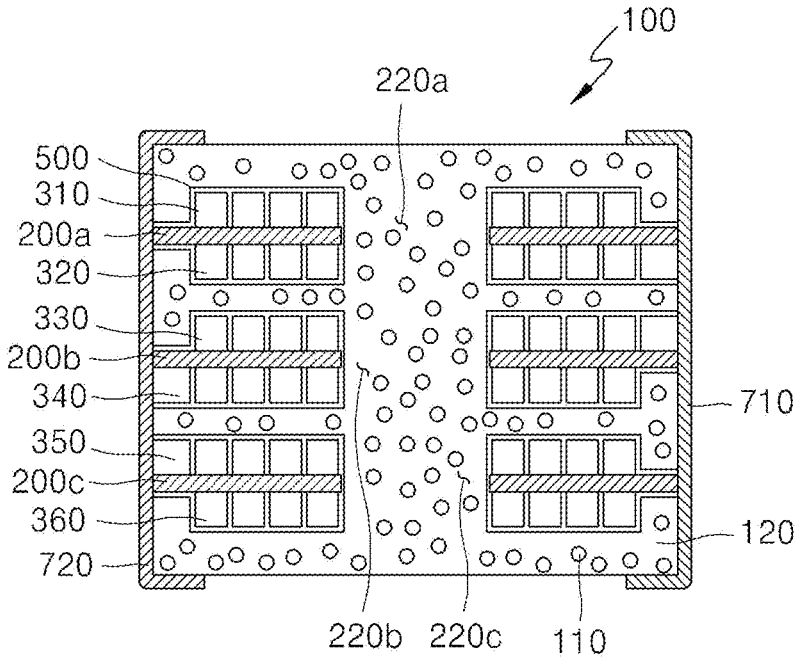

FIGS. 27 to 28 are cross-sectional views illustrating a modified example of a power inductor in accordance with further another exemplary embodiment. That is, three bases 200 (200*a*, 200*b*, and 200*c*) may be provided in the body 100, coil patterns 300 (310, 320, 330, 340, 350, and 360) may be disposed on one surface and the other surface of each of the bases 200, the coil patterns 310 and 360 may be connected to external electrodes 410 and 420, and coil patterns 320 and 330 may be connected to a connection electrode 710, and the coil patterns 340 and 350 may be connected to a connection electrode 720. Thus, the coil patterns 300 respectively disposed on the three bases 200*a*, 200*b*, and 200*c* may be connected to each other in series by the connection electrodes 710 and 720.

As described above, in the power inductors in accordance with further another exemplary embodiment and modified examples, the at least two bases 200 on which each of the coil patterns 300 is disposed on at least one surface may be spaced apart from each other within the body 100, and the coil pattern 300 disposed on the other base 200 may be connected by the connection electrode 700 outside the body 100. As a result, the plurality of coil patterns may be provided within one body 100, and thus, the power inductor may increase in capacity. That is, the coil patterns 300 respectively disposed on the bases 200 different from each other may be connected to each other in series by using the connection electrode 700 outside the body 100, and thus, the power inductor may increase in capacity on the same area.

Figure 29:
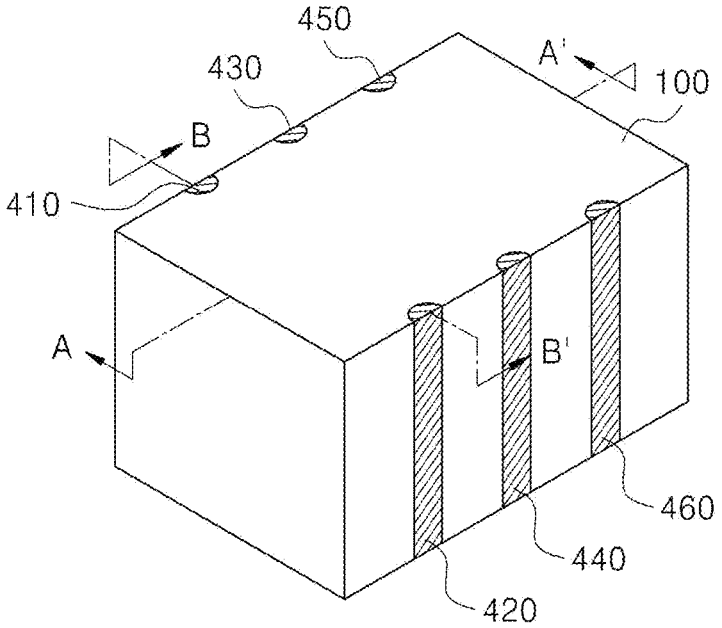
FIG. 29 is a perspective view of a power inductor in accordance with still another exemplary embodiment.
Figure 30:
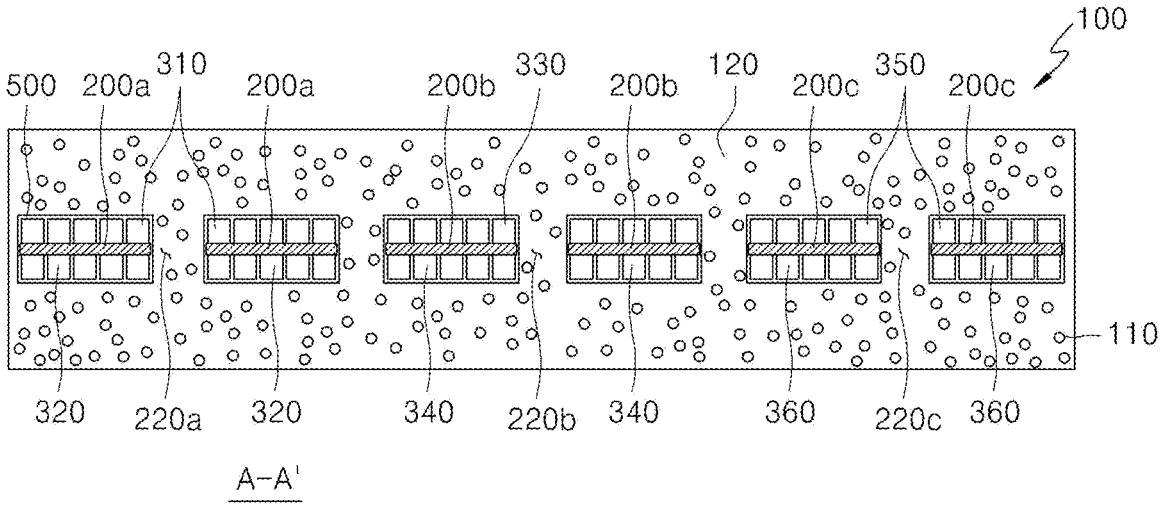
FIGS. 30 and 31 are cross-sectional views taken along lines A-A' and B-B' of FIG. 29, respectively.
Figure 31:
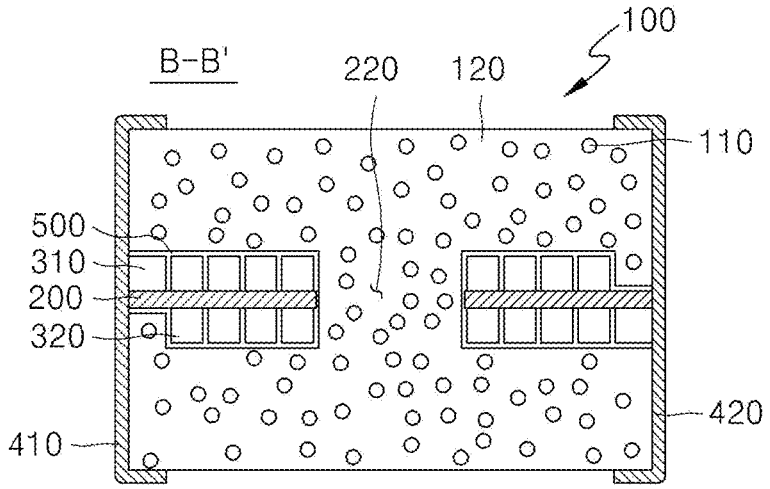
Figure 32:
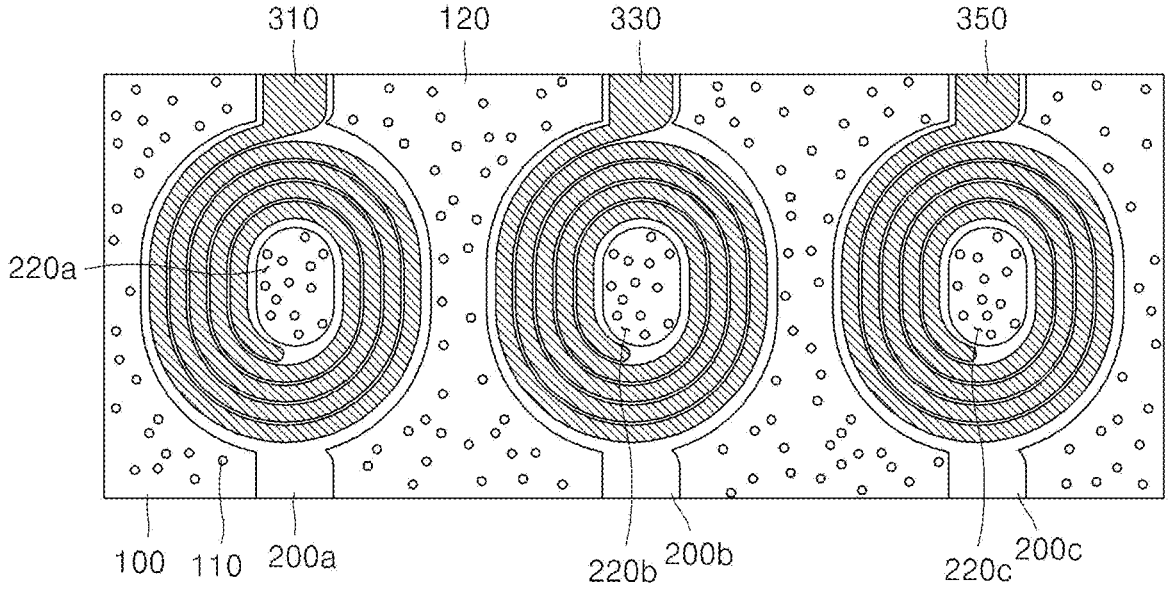
FIG. 32 is an internal plan view of FIG. 29.

FIG. 29 is a perspective view of a power inductor in accordance with still another exemplary embodiment, and FIGS. 30 and 31 are cross-sectional views taken along lines A-A' and B-B' of FIG. 29. Also, FIG. 32 is an internal plan view.

Referring to FIGS. 29 to 32, a power inductor in accordance with further another exemplary embodiment may include a body 100, at least two bases 200*a*, 200*b*, and 200*c* (200) provided in the body 100 in a horizontal direction, coil patterns 310, 320, 330, 340, 350, and 360 (300) disposed on at least one surface of each of the at least two bases 200, external electrodes 410, 420, 430, 440, 450, and 460 disposed outside the body 100 and disposed on the at least two bases 200*a*, 200*b*, and 200*c*, and an insulation layer 500 disposed on the coil patterns 300. Hereinafter, descriptions duplicated with the foregoing embodiments will be omitted.

At least two, e.g., three bases 200 (200*a*, 200*b*, and 200*c*) may be provided in the body 100. Here, the at least two bases 200 may be spaced a predetermined distance from each other in a long axis direction that is perpendicular to a thickness direction of the body 100. That is, in further another exemplary embodiment and the modified example, the plurality of bases 200 are arranged in the thickness direction of the body 100, e.g., in a vertical direction. However, in still another exemplary embodiment, the plurality of bases 200 may be arranged in a direction perpendicular to the thickness direction of the body 100, e.g., a horizontal direction. Also, conductive vias 210 (210*a*, 210*b*, and 210*c*) may be formed in the plurality of bases 200, respectively. Here, at least a portion of each of the plurality of bases 200 may be removed to form each of through-holes 220 (220*a*, 220*b*, and 220*c*). Of course, an area of the plurality of bases 200, in which the through-holes 220 and the coil patterns 300 are not provided, may be removed as illustrated in FIG. 23, and then, the body 100 may be filled.

The coil patterns 300 (310, 320, 330, 340, 350, and 360) may be disposed on at least one surface of each of the plurality of bases 200, preferably, both surfaces of each of the plurality of bases 200. Here, the coil patterns 310 and 320 may be disposed on one surface and the other surface of a first substrate 200*a* and electrically connected to each other by the conductive via 210*a* provided in the first base 200*a*. Also, the coil patterns 330 and 340 may be disposed on one surface and the other surface of a second substrate 200*b* and electrically connected to each other by the conductive via 210*b* provided in the second base 200*b*. Similarly, the coil patterns 350 and 360 may be disposed on one surface and the other surface of a third substrate 200*c* and electrically connected to each other by the conductive via 210*c* provided in the third base 200*c*. Each of the plurality of coil patterns 300 may be formed in a spiral shape on a predetermined area of the base 200, e.g., outward from the through-holes 220*a*, 220*b*, and 200*c* in a central portion of the base 200. The two coil patterns 310 and 320 disposed on the base 200 may be connected to each other to form one coil. That is, at least two coils may be provided in one body 100. Here, the coil patterns 310, 330, and 350 that are disposed on one side of the base 200 and the coil patterns 320, 340, and 360 that are disposed on the other side of the base 200 may have the same shape. Also, the coil patterns 300 may overlap each other on the same base 200. Alternatively, the coil patterns 320, 330, and 350 that are disposed on the one side of the base 200 may be disposed to overlap an area on which the coil patterns 320, 340, and 360 that are disposed on the other side of the base 200 are not disposed.

The external electrodes 400 (410, 420, 430, 440, 450, and 460) may be spaced apart from each other on both ends of the body 100. The external electrode 400 may be electrically connected to the coil patterns 300 respectively disposed on the plurality of bases 200. For example, the external electrodes 410 and 420 may be respectively connected to the coil patterns 310 and 320, the external electrode 430 and 440 may be respectively connected to the coil patterns 330 and 340, and the external electrodes 450 and 460 may be respectively connected to the coil patterns 350 and 360. That is, the external electrodes 400 may be respectively connected to the coil patterns 300 and 340 disposed on the bases 200*a*, 200*b*, and 200*c*.

As described above, in the power inductor according to the fourth embodiment of the present inventive concept, the plurality of inductors may be realized in one body 100. That is, the at least two bases 200 may be arranged in the horizontal direction, and the coil patterns 300 respectively disposed on the bases 200 may be connected to each other by the external electrodes different from each other. Thus, the plurality of inductors may be disposed in parallel, and at least two power inductors may be provided in one body 100.

Figure 33:
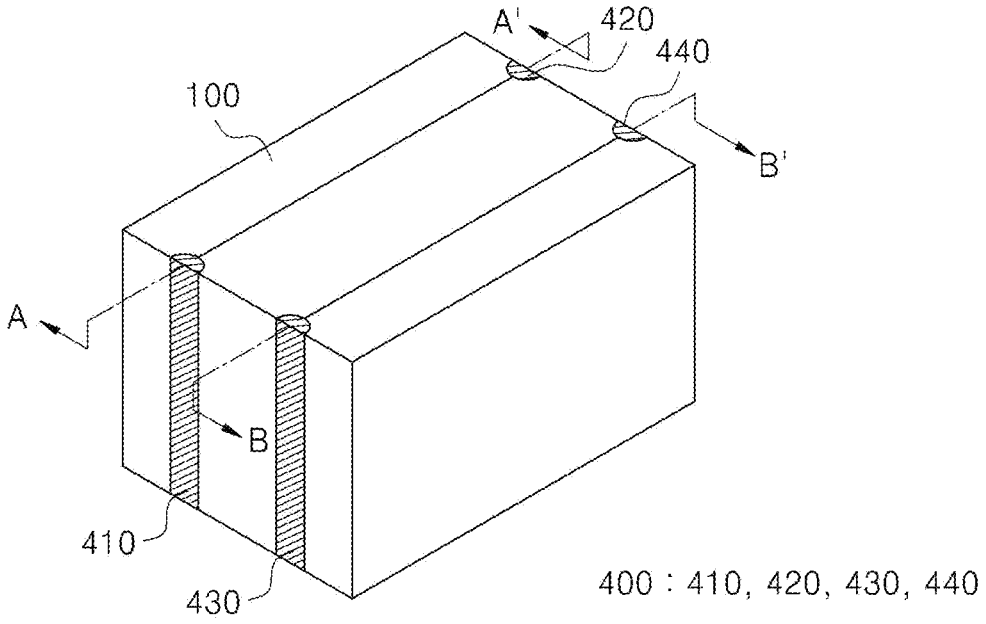
FIG. 33 is a perspective view of a power inductor in accordance with yet another exemplary embodiment.
Figure 34:
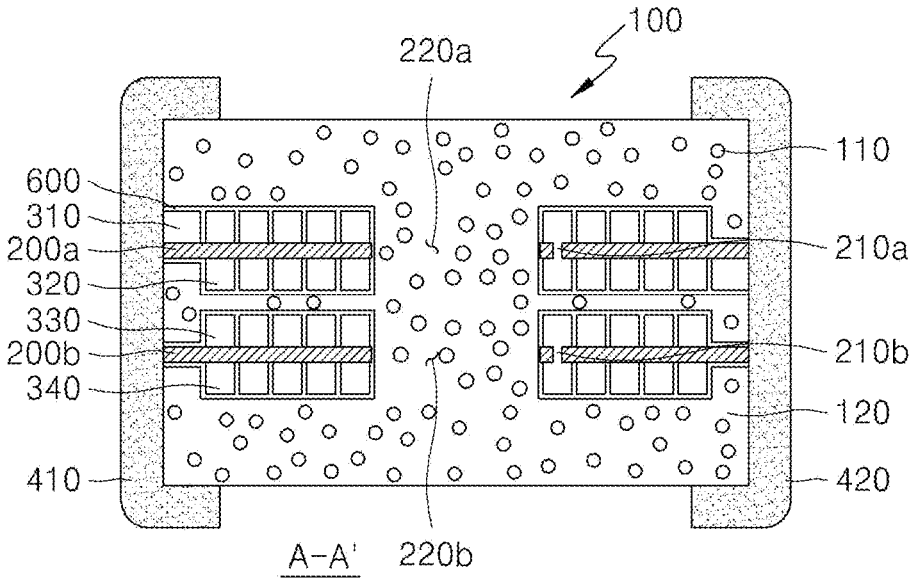
FIGS. 34 and 35 are cross-sectional views taken along lines A-A' and B-B' of FIG. 33, respectively.
Figure 35:
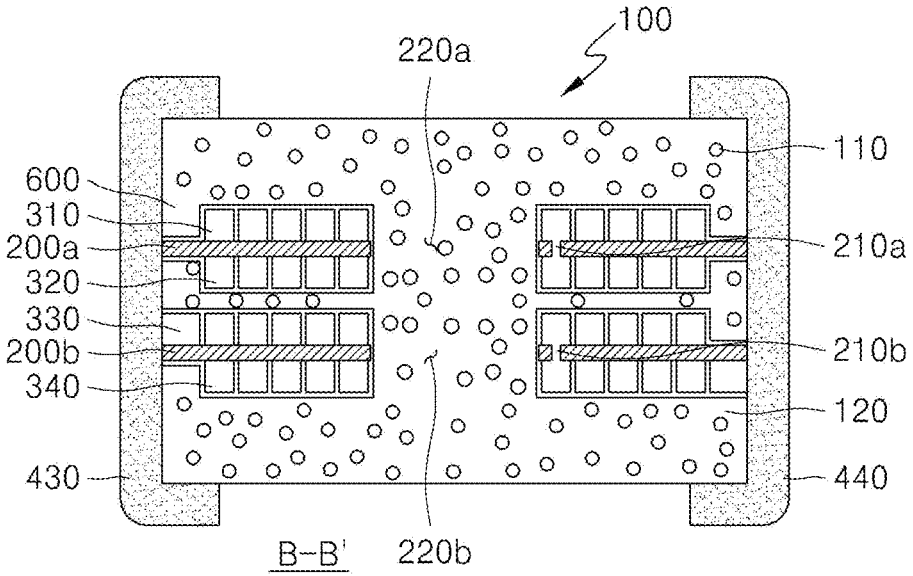

FIG. 33 is a perspective view of a power inductor in accordance with yet another exemplary embodiment, and FIGS. 34 and 35 are cross-sectional views taken along lines A-A' and B-B' of FIG. 33.

Referring to FIGS. 33 to 35, a power inductor in accordance with yet another exemplary embodiment may include a body 100, at least two bases 200 (200*a* and 200*b*) provided in the body 100, coil patterns 300 (310, 320, 330, and 340) disposed on at least one surface of each of the at least two bases 200, and a plurality of external electrodes 400 (410, 420, 430, and 440) disposed on two side surfaces facing of the body 100 and respectively connected to the coil patterns 310, 320, 330, and 340 disposed on the bases 200*a* and 200*b*. Here, the at least two bases 200 may be spaced a predetermined distance from each other and laminated in a thickness direction of the body 100, i.e., in a vertical direction, and the coil patterns 300 disposed on the bases 200 may be withdrawn in directions different from each other and respectively connected to the external electrodes. That is, in still another exemplary embodiment, the plurality of bases 200 may be arranged in the horizontal direction. However, in yet another exemplary embodiment, the plurality of bases may be arranged in the vertical direction. Thus, in yet another exemplary embodiment, the at least two bases 200 may be arranged in the thickness direction of the body 100, and the coil patterns 300 respectively disposed on the bases 200 may be connected to each other by the external electrodes different from each other, and thus, the plurality of inductors may be disposed in parallel, and at least two power inductors may be provided in one body 100.

As described above, in the foregoing embodiments, which are described with reference to FIGS. 24 to 35, the plurality of bases 200, on which the coil patterns 300 disposed on the at least one surface within the body 10 are disposed, may be laminated in the thickness direction (i.e., the vertical direction) of the body 100 or arranged in the direction perpendicular to (i.e., the horizontal direction) the body 100. Also, the coil patterns 300 respectively disposed on the plurality of bases 200 may be connected to the external electrodes 400 in series or parallel. That is, the coil patterns 300 respectively disposed on the plurality of bases 200 may be connected to the external electrodes 400 different from each other and arranged in parallel, and the coil patterns 300 respectively disposed on the plurality of bases 200 may be connected to the same external electrode 400 and arranged in series. When the coil patterns 300 are connected in series, the coil patterns 300 respectively disposed on the bases 200 may be connected to the connection electrodes 700 outside the body 100. Thus, when the coil patterns 300 are connected in parallel, two external electrodes 400 may be required for the plurality of bases 200. When the coil patterns 300 are connected in series, two external electrodes 400 and at least one connection electrode 700 may be required regardless of the number of bases 200. For example, when the coil patterns 300 disposed on the three bases 300 are connected to the external electrodes in parallel, six external electrodes 400 may be required. When the coil patterns 300 disposed on the three bases 300 are connected in series, two external electrodes 400 and at least one connection electrode 700 may be required. Also, when the coil patterns 300 are connected in parallel, a plurality of coils may be provided within the body 100. When the coil patterns 300 are connected in series, one coil may be provided within the body 100.

The present inventive concept may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

The invention claimed is:

1. A power inductor comprising:

a body comprising metal powder and a polymer;

at least one base provided in the body; and at least one coil pattern disposed on at least one surface of the base, wherein the metal powder comprises a first metal powder, a second metal powder, and a third metal powder, wherein the first to third metal powders have different middle values of grain size distribution, wherein the first to third metal powders is made of an alloy containing Fe, Si and Cr, wherein each of the first to third metal powders has a different content of at least one of Fe, Si and Cr, wherein the metal powder further comprises a fourth metal powder having a middle value of grain-size distribution that is different from the middle value of grain-size distribution of at least one of the first metal powder, the second metal powder and the third metal powder, and wherein the fourth metal powder is made of an alloy containing Fe and does not contain Si or Cr.

2. The power inductor of claim 1, wherein a middle value of grain-size distribution of the first metal powder is 20 μm to 100 μm, a middle value of grain-size distribution of the second metal powder is 2 μm to 20 μm, and a middle value of grain-size distribution of the third metal powder is 1 μm to 10 μm.

3. The power inductor of claim 1, wherein 50 wt % to 90 wt % of the first metal powder, 5 wt % to 25 wt % of the second metal powder, and 5 wt % to 25 wt % of the third metal powder with respect to 100 wt % of the metal powder are contained.

4. The power inductor of claim 1, wherein each of the second and third metal powder has a Fe content greater than that of the first metal powder.

5. The power inductor of claim 1, wherein the second metal powder has a Si content greater than that of the third metal powder and a Cr content less than that of the third metal powder.

6. The power inductor of claim 1, wherein at least one of the first to fourth metal powder is crystalline.

7. The power inductor of claim 1, wherein at least one region of the base is removed, and the body is filled into the at least one region of the base.

8. The power inductor of claim 7, wherein the base has a curved surface that protrudes with respect to a side surface of the body by removing an entire outer area of the coil pattern.

9. The power inductor of claim 1, wherein the at least one coil pattern includes a plurality of coil patterns disposed on different surfaces of the base, wherein the plurality of coil patterns have the same height, which is higher 2.5 times than a thickness of the base.

10. The power inductor of claim 9, wherein each coil pattern of the plurality of coil patterns comprises a first plated layer disposed on the base and a second plated layer disposed to cover the first plated layer.

11. The power inductor of claim 1, wherein at least two regions of the at least one coil pattern have different widths.

12. The power inductor of claim 1, further comprising an insulation layer between the at least one coil pattern and the body, wherein the insulation layer is disposed at a uniform thickness on top and side surfaces of the at least one coil pattern and has the same thickness as that of each of the top and side surfaces of the at least one coil pattern on the base.

13. The power inductor of claim 6, at least one of the first to fourth metal powder is amorphous.

* * * * *